US007939802B2

(12) United States Patent
Guinn et al.

(10) Patent No.: US 7,939,802 B2
(45) Date of Patent: May 10, 2011

(54) TARGET WITH THERMAL IMAGING SYSTEM

(76) Inventors: Charlie Grady Guinn, Lewistown, MT (US); Edward Donald Schoppman, Oak Ridge, NC (US)

( * ) Notice: Subject to any disclaimer, the term of this patent is extended or adjusted under 35 U.S.C. 154(b) by 172 days.

(21) Appl. No.: 12/500,601

(22) Filed: Jul. 10, 2009

(65) Prior Publication Data

US 2009/0314940 A1 Dec. 24, 2009

Related U.S. Application Data

(63) Continuation-in-part of application No. 12/467,780, filed on May 18, 2009, now Pat. No. 7,820,969, and a continuation-in-part of application No. 12/052,792, filed on Mar. 21, 2008, now Pat. No. 7,667,213.

(51) Int. Cl.
*G02F 1/00* (2006.01)

(52) U.S. Cl. ..... 250/330

(58) Field of Classification Search ..... 250/332, 250/504 R; 273/348, 348.1, 408
See application file for complete search history.

(56) References Cited

U.S. PATENT DOCUMENTS

| | | | | |
|---|---|---|---|---|
| 4,240,212 | A | 12/1980 | Marshall et al. | |
| 4,260,160 | A | 4/1981 | Ejnell et al. | |
| 4,346,901 | A | 8/1982 | Booth | |
| 4,405,132 | A | 9/1983 | Thalmann | |
| 4,422,646 | A | 12/1983 | Rosa | |
| 4,546,983 | A | 10/1985 | Rosa | |
| 4,659,089 | A | 4/1987 | Rosa | |
| 4,792,142 | A | 12/1988 | Davies | |
| 5,065,032 | A | 11/1991 | Prosser | |
| 5,066,019 | A | 11/1991 | Dean et al. | |
| 5,296,270 | A | 3/1994 | Prosser | |
| 5,319,213 | A | 6/1994 | Watkins et al. | |
| 5,901,959 | A | 5/1999 | Tessiot | |
| 5,969,369 | A | 10/1999 | Fogarty | |
| 6,315,294 | B1 | 11/2001 | Belleville | |
| 6,337,475 | B1 | 1/2002 | Miglirini | |
| 6,767,015 | B1 | 7/2004 | Parsley | |
| 6,806,480 | B2 | 10/2004 | Reshef | |
| 7,377,517 | B2 | 5/2008 | Andren et al. | |
| 2007/0013137 | A1 | 1/2007 | Andren et al. | |
| 2007/0205560 | A1 | 9/2007 | Hebble | |
| 2008/0169609 | A1 | 7/2008 | Hetland | |
| 2008/0296842 | A1 | 12/2008 | Novak et al. | |
| 2009/0194942 | A1 * | 8/2009 | Hodge | 273/348.1 |

* cited by examiner

*Primary Examiner* — David P Porta
*Assistant Examiner* — Marcus H Taningco
(74) *Attorney, Agent, or Firm* — Antoinette M. Tease

(57) ABSTRACT

A target with a thermal imaging system comprising one or more sections. Each section comprises at least one heater. Each heater comprises a layer of insulating material, layer of bifurcated metallic foil, layer of plastic, wire grid comprised of horizontal elements and vertical wires, at least two strips of carbon tape, and front cover sheet. The layer of metallic foil is situated on top of the layer of insulating material, the layer of plastic is situated on top of the layer of metallic foil, and the wire grid is situated on top of the layer of plastic. The strips of carbon tape are adhered to the outer edges of the wire grid so that the carbon tape comes into contact with the horizontal elements but not with the vertical wires. The front cover sheet comprises an image of a side view, front view or rear view of a vehicle.

37 Claims, 25 Drawing Sheets

TARGET WITH THERMAL IMAGING SYSTEM

CROSS-REFERENCE TO RELATED APPLICATION

This application is a continuation-in-part of U.S. patent application Ser. No. 12/467,780 filed on May 18, 2009, which is a continuation-in-part of U.S. patent application Ser. No. 12/052,792 filed on Mar. 21, 2008. The contents of these applications are incorporated herein by reference.

BACKGROUND OF THE INVENTION

1. Field of the Invention

The present invention relates generally to the field of targets, and more specifically, to human and vehicle targets constructed with a thermal imaging system.

2. Description of the Related Art

Infrared and other thermal-related detection devices have become increasingly important, particularly in combat. This technology has not been effectively deployed, however, for the purpose of assisting soldiers in distinguishing friendly soldiers from enemy combatants. One of the challenges facing soldiers in the field who employ heat detection devices such as infrared detectors is that the identity of a target is not readily discernible based on the mere existence of a heat signature. For example, animals, vehicles and random mechanical devices may all emit heat and, therefore, present themselves as a potential target. Without the right kind of target, heat detection device cannot differentiate between humans and other animals or things that emit heat.

A human body emits various levels of heat depending on the area of the body. For example, the top of the head emits less heat than the armpit region, and the chest area generally emits less heat than the top of the head but more heat than the armpit region. These variations in temperature can make the heat signature difficult to replicate in a target. In addition, heat signatures vary according to the ambient temperature. Although one would expect more heat to be emitted in higher ambient temperatures, certain regions of the body emit a disproportionately high amount of heat in higher temperatures. Accordingly, a human heat signature in one ambient temperature may vary significantly from an emitted heat signature in another temperature.

Although it is beneficial to train soldiers to detect human versus non-human heat signatures and to detect human heat signatures in various ambient temperatures, it is also critically important to train soldiers in differentiating one human heat signature from another. When a human is holding or carrying a weapon or other equipment, the resulting heat signature is characterized by a "cold spot" in the image corresponding to the location at which the body heat is blocked by the equipment. This characteristic in the heat signature is useful in identifying friendly versus enemy soldiers where the object causing the heat interference is specific to either the friendly or enemy soldier. For example, a soldier carrying an AK-47 or rocket-propelled grenade may be differentiated from U.S. or NATO soldiers who carry different weaponry and equipment. It is also important to train soldiers to distinguish different types of vehicles based on their heat signatures.

Accordingly, it is an object of the present invention to provide a target with a thermal imaging system that emulates a human or vehicle heat signature by allowing for different heat output in different heating zones. It is a further object of the present invention to provide a thermal imaging system in which the thermal output can be varied to accommodate different ambient temperatures. Lastly, it is an object of the present invention to provide a thermal imaging system that can be shot at numerous times and still continue to function. The present invention meets each of these objectives, as described more fully below.

BRIEF SUMMARY OF THE INVENTION

The present invention is a target with a thermal imaging system comprising a layer of corrugated plastic; a layer of bifurcated metallic foil; a layer of plastic; a wire grid; two strips of carbon tape; a front cover sheet; and a power lead with two first ends and a second end; wherein the layer of bifurcated metallic foil is situated on top of the layer of corrugated plastic; wherein the layer of plastic is situated on top of the layer of bifurcated metallic foil; wherein the wire grid is situated on top of the layer of plastic and comprises a right side and a left side; wherein one strip of carbon tape is adhered to the right side of the wire grid, and the other strip of carbon tape is adhered to the left side of the wire grid; wherein the front cover sheet is adhered to the target so that it covers the wire grid and carbon tape; and wherein the power lead comprises two first ends and a second end, each of the strips of carbon tape comprises a first end, one of the first ends of the power lead is connected to the first end of one of the carbon strips, the other first end of the power lead is connected to the first end of the other carbon strip, and the second end of the power lead is a connector plug. In an alternate embodiment, the first ends of the power lead are crimped directly to the bifurcated metallic foil.

In a preferred embodiment, the first ends of the power lead ate comprised of tin, each first end of the power lead comprises teeth, and the teeth punch through the carbon tape and the layer of metallic foil when the first end of the power lead is connected to the first end of the carbon strip.

In a preferred embodiment, the present invention further comprises a hard plastic backing that is fastened to the corrugated plastic layer and that is used to secure the target in a target lift device. Preferably, the hard plastic backing is fastened to the corrugated plastic layer in a manner that allows the target to be bent vertically to fit into a target lift device. The layer of corrugated plastic preferably comprises an uppermost edge, and wherein a layer of caulk is applied to the uppermost edge of the layer of corrugated plastic.

In a preferred embodiment, the wire grid comprises a plurality of horizontal wires and a plurality of vertical wires, each horizontal wire comprises a first end and a second end, the first end of each horizontal wire comes into contact with one of the strips of carbon tape, the second end of each horizontal wire comes into contact with the other strip of carbon tape, and none of the vertical wires comes into contact with either of the strips of carbon tape. Preferably, the vertical wires are positioned on top of the horizontal wires. The vertical wires are preferably approximately one-half inch apart, and the vertical wires are preferably approximately one inch apart.

In a preferred embodiment, the wire grid is constructed so as to provide different heating zones within the target. Preferably, the different heating zones comprise a head zone, a shoulder zone, and a body zone, the wire grid comprises a plurality of horizontal wires and a plurality of vertical wires, each horizontal wire has a diameter, and the diameter of the horizontal wires differs among the heating zones. Preferably, the wire grid comprises a plurality of horizontal wires and a plurality of vertical wires, the horizontal wires are comprised of a nickel and chrome alloy, each horizontal wire has a diameter, the diameter of the horizontal wires in the head zone is roughly 0.0014 inches, the diameter of the horizontal wires in the shoulder zone is roughly 0.00175 inches, and the diameter of the horizontal wires in the body zone is roughly 0.002 inches. Preferably, the wire grid comprises a plurality of horizontal wires and a plurality of vertical wires, the vertical wires are comprised of a copper and nickel alloy, each vertical wire has a diameter, and the diameter of each vertical wire is roughly 0.004 inches.

In a preferred embodiment, the wire grid comprises a plurality of horizontal wires and a plurality of vertical wires, and the target further comprises a cap zone containing no horizontal wires and into which none of the vertical wires extends. Preferably, the wire grid comprises a plurality of horizontal wires and a plurality of vertical wires, the target has a front surface, and horizontal and vertical wires together comprise less than two percent of the front surface of the target.

In a preferred embodiment, the bifurcated foil layer comprises two outer edges, the first layer of plastic prevents the vertical wires from coming into contact with the bifurcated foil layer, and the first layer of plastic prevents the horizontal wires from coming into contact with the bifurcated foil layer other than at the outer edges of the bifurcated foil layer.

The present invention optionally comprises a silhouette accessory, wherein the silhouette accessory comprises at least one thermal block with a removable strip and an outer surface comprising an adhesive layer that allows the thermal block to be adhered to the front cover sheet.

In yet another embodiment, the present invention is a target with a thermal imaging system comprising one or more sections, wherein each section of the target comprises at least one heater, and wherein each heater comprises a layer of insulating material, a layer of bifurcated metallic foil, a layer of plastic, a wire grid comprised of a plurality of horizontal elements and a plurality of vertical wires, at least two strips of carbon tape, and a front cover sheet; wherein the layer of bifurcated metallic foil is situated on top of the layer of insulating material; wherein the layer of plastic is situated on top of the layer of bifurcated metallic foil; wherein the layer of insulating material is at least as large as the layer of bifurcated metallic foil; wherein the wire grid is situated on top of the layer of plastic and comprises at least two outer edges; wherein one strip of carbon tape is adhered to one of the outer edges of the wire grid, and the other strip of carbon tape is adhered to another outer edge of the wire grid so that both strips of carbon tape come into contact with the horizontal elements but not with the vertical wires; wherein the front cover sheet is adhered to the heater so that it covers the wire grid and carbon tape; and wherein the front cover sheet comprises an image of a side view, front view or rear view of a vehicle. Preferably, each section has an outline, when the target is assembled, the outlines of the sections form a single, combined outline, and the single, combined outline is an outline of a vehicle.

In a preferred embodiment, the present invention further comprises a power lead with two first ends, and each first end of the power lead is attached to one of the strips of carbon tape. In an alternate embodiment, the present invention further comprises a power lead with two first ends, the layer of bifurcated metallic foil comprises two halves, and each first end of the power lead is attached directly to one half of the layer of bifurcated metallic foil. Preferably, the first ends of the power lead are comprised of tin.

In a preferred embodiment, the sections of the target are affixed to a rigid backing. Optionally, the rigid backing is attached to a target lift device.

In a preferred embodiment, the layer of insulating material is polycarbonate film. Preferably, each horizontal element is comprised of multiple wires spun around a fiberglass strand. The vertical wires are preferably positioned on top of the horizontal elements.

In a preferred embodiment, the layer of bifurcated metallic foil is comprised of aluminum. In one embodiment, the layer of bifurcated metallic foil comprises one or more flaps that fold around behind the layer of insulating material. The layer of plastic is preferably transparent.

In a preferred embodiment, the bifurcated foil layer has one or more outer edges, the layer of plastic prevents the vertical wires from coming into contact with the bifurcated foil layer, and the layer of plastic prevents the horizontal elements from coming into contact with the bifurcated foil layer other than at the outer edges of the bifurcated foil layer. Preferably, the front cover sheet is comprised of vinyl with an adhesive backing.

In a preferred embodiment, each heater is comprised of one or more heating zones, and each heating zone generates a particular wattage that is different than the wattage of the other heating zones within the same heater. Preferably, the horizontal elements are located within a heating zone, and the horizontal elements are spaced from one another within the heating zone so as to generated a desired wattage within the heating zone within which the horizontal elements are located. The front cover sheet is preferably a single front cover sheet that covers all of the sections of the target.

In one embodiment, the present invention comprises an overlay; each section of the target has a front surface; the overlay is comprised of a layer of corrugated plastic, one or more thermal blocks comprised of corrugated plastic, and a front cover sheet; the front cover sheet is adhered to a front surface of the corrugated plastic layer, and the thermal block (s) is/are adhered to a rear surface of the corrugated plastic layer; and the thermal block(s) is/are adhered to the front surface of one of the sections of the target. In an alternate embodiment, the present invention further comprises an overlay; each section of the target has a front surface; the overlay is comprised of a layer of polycarbonate film, at least one stand-off comprised of at least one strip of polycarbonate film, and a front cover sheet; the front cover sheet is adhered to a front surface of the polycarbonate film layer, and the stand-off(s) is/are adhered to a rear surface of the polycarbonate film layer; and the stand-off(s) is/are are adhered to the front surface of one of the sections of the target.

REFERENCE NUMBERS

Figure 1:
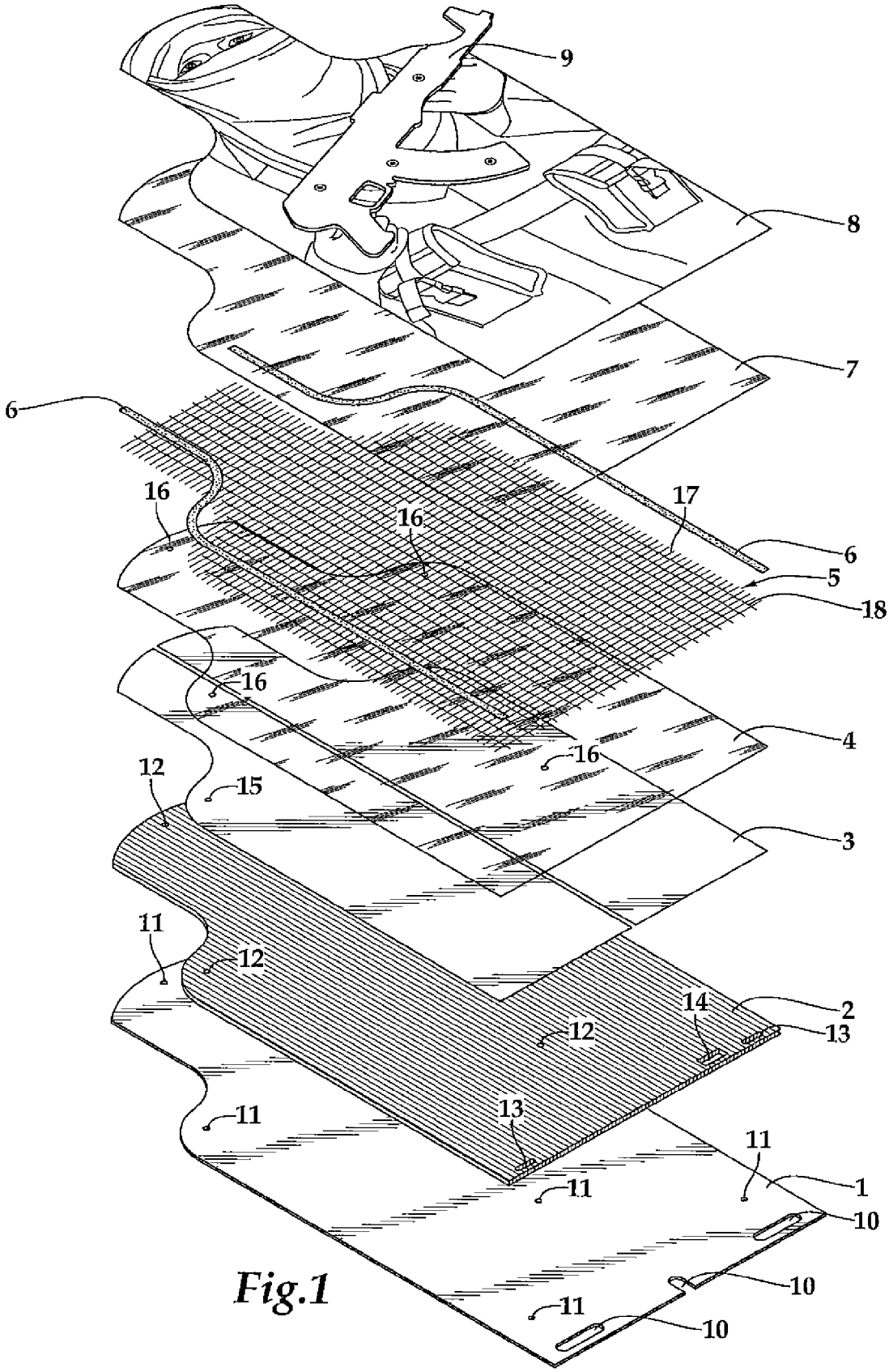
FIG. 1 is an exploded view of the present invention.

1 Hard plastic backing
2 Corrugated plastic layer
3 Bifurcated foil layer
4 First layer of clear plastic
5 Wire grid
6 Carbon tape
7 Second layer of clear plastic
8 Front cover sheet
9 Silhouette accessory
10 Cut-out (in hard plastic backing)
11 Aperture (in hard plastic backing)
12 Aperture (in corrugated plastic layer)
13 Cut-out (in corrugated plastic layer) for rivet
14 Cut-out (in corrugated plastic layer) for second end of power lead
15 Aperture (in bifurcated aluminum layer)
16 Aperture (in first clear plastic layer)
17 Horizontal wire
18 Vertical wire
19 Head zone
20 Body zone
21 Shoulder zone
22 Cap zone
23 First end of power lead
24 Second end of power lead
25 First rivet
26 Spacer component
27 Second rivet
28 Rivet backing
29 Silhouette accessory
30 Thermal block
31 Removable strip
32 Outer adhesive surface (of thermal block)
33 Power lead
34 First part (of vehicle target)
35 Second part (of vehicle target)
36 Third part (of vehicle target)
37 Fourth part (of vehicle target)
38 Fifth part (of vehicle target)
39 Sixth part (of vehicle target)
40 Seventh part (of vehicle target)
41 First vehicle overlay
42 Second vehicle overlay
43 Third vehicle overlay
44 Vehicle nose piece
45 Rigid backing
46 Polycarbonate film layer (of vehicle target heater)
47 Bifurcated foil layer (of vehicle target heater)
48 Plastic layer (of vehicle target heater)
49 Wire grid (of vehicle target heater)
50 Carbon tape (of vehicle target heater)
51 Front cover sheet (of vehicle target heater)
52 Foil flap
53 First heater (of first part of vehicle target)
54 Second heater (of first part of vehicle target)
55 Cut-out (in front cover sheet of first part of vehicle target)
56 Gap
57 Portion of first part
58 First heating zone (of second part)
59 Second heating zone (of second part)
60 Third heating zone (of second part)
61 First heating zone (of third part)
62 Second heating zone (of third part)
63 Third heating zone (of third part)
64 First heating zone (of fourth part)
65 Second heating zone (of fourth part)
66 Third heating zone (of fourth part)
67 First heating zone (of fifth part)

68 Second heating zone (of fifth part)
69 Third heating zone (of fifth part)
70 Non-heating zone (of fifth part)
71 Door area
72 First heating zone (of sixth part)
73 Second heating zone (of sixth part)
74 Third heating zone (of sixth part)
75 First heating zone (of seventh part)
76 Second heating zone (of seventh part)
77 Polycarbonate film layer (of vehicle overlay)
78 Front cover sheet (of vehicle overlay)
79 Polycarbonate film strip (of vehicle overlay)
80 Layer of corrugated plastic (of vehicle overlay)
81 Thermal block (of vehicle overlay)
82 Removable strip (of vehicle overlay)
83 Outer adhesive surface (of thermal block)
84 Polycarbonate film layer (of nose piece)
85 Front cover sheet (of nose piece)
86 Polycarbonate film layer (of wheel embodiment)

DETAILED DESCRIPTION OF INVENTION

FIG. 1 is an exploded view of the present invention. As shown in this figure, the present invention comprises a hard plastic backing 1, a corrugated plastic layer 2, a bifurcated layer of metallic foil 3 (preferably aluminum), a first layer of clear plastic 4 (this layer is clear in a preferred embodiment but does not necessary need to be clear), a wire grid 5, two strips of carbon tape 6, and a second layer of clear plastic 7 that is used only during the manufacturing process and removed prior to installation of the front cover sheet 8. (As used in the claims, the term "clear plastic layer" refers to the first clear plastic layer 4 because the second clear plastic layer 7 is not part of the final product.) The carbon tape 6 used in the present invention is preferably a carbon-filled electrically conductive adhesive strip (i.e., nonwoven carbon paper that is saturated with adhesive). The present invention further comprises a front cover sheet 8 and optional silhouette accessory 9.

The hard plastic backing 1 is used to secure the target in a target lift device, such as those currently in use by the military. In a preferred embodiment, the hard plastic backing 1 also provides sufficient mechanical resistance so that when the target is hit (shot at), the target lifter will cause the target to fall down. Without a backing made of hard plastic or similarly mechanically resistant material, the target will heat as intended, but it will not fall down when hit. Thus, although some type of backing is needed to secure the target to the target lift device, a hard plastic backing 1 is preferred for those applications in which it is important to cause the target to fall down when hit.

The hard plastic backing 1 preferably comprises one or more cut-outs 10 that allow the hard plastic backing 1 to be secured to a target lift device. The exact size and shape of these cut-outs 10 will depend on the target lift device to which the hard plastic backing 1 is secured. Some target device may not require any cut-outs at all. The present invention is not limited to any particular shape, size or number of cut-outs 10, or any cut-outs at all, in the hard plastic backing 1. The hard plastic backing 1 also comprises a plurality of apertures 11 that are used to secure the hard plastic backing 1 to the corrugated plastic layer 2, as described more fully below.

Figure 4A:
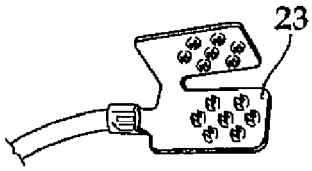
FIG. 4A is a detail view of a first end of the power lead of the present invention.

The corrugated plastic layer 2 is a non-conductive layer that serves as the template upon which the wire grid 5 is supported. As shown in FIG. 1, the corrugations in this layer preferably run vertically. The corrugated plastic layer 2 preferably comprises two cut-outs 13 that are used to secure the corrugated plastic layer 2 to the hard plastic backing 1. In a preferred embodiment, the corrugated plastic layer 2 also comprises a cut-out 14 that is used to stow one end of the power lead when the power lead is not in use (see FIG. 4D).

All of the layers shown in FIG. 1 are in the shape of a human target. The corrugated plastic layer 2 is preferably the same size as the hard plastic backing 1, except that the hard plastic backing 1 is longer (at the bottom) than the corrugated plastic layer 2. In a preferred embodiment, the corrugated plastic layer 2 comprises a layer of caulk (not shown) on the uppermost edge of the corrugated plastic layer 2. The purpose of the caulk is two-fold: (i) to prevent water or other precipitation and/or debris from entering the corrugated plastic layer 2 and (ii) to prevent heat from escaping from inside of the corrugated plastic layer 2 into the atmosphere.

The bifurcated foil layer 3 is electrically conductive, and it is bifurcated to prevent short circuits from occurring when the wire grid 5 is energized. The bifurcated foil layer 3 is preferably slightly shorter and narrower than the corrugated plastic layer 2. The bifurcated foil layer 3 also comprises apertures 15 for securing the corrugated plastic layer 2 (and the other layers that rest on top of it, namely, the bifurcated foil layer 3, the first clear plastic layer 4, the wire grid 5, and the carbon tape 6) to the hard plastic backing 1. The bifurcated foil layer 3 preferably comprises an adhesive on either side (back and front) so as to facilitate adhesion to the corrugated plastic layer 2 and the first clear plastic layer 4.

The next layer after the bifurcated foil layer 3 is the first clear plastic layer 4. This layer is roughly the same size as the bifurcated foil layer 3, except that it is not bifurcated. The first clear plastic layer 4 is preferably the same length as the bifurcated foil layer 2 but slightly narrower than the bifurcated foil layer 2. The purpose of the first clear plastic layer is to prevent the wire grid 5 from touching the bifurcated foil layer 3 other than at the outer vertical edges of the bifurcated foil layer 3. The first clear plastic layer 4 preferably comprises an adhesive on both sides (back and front) so as to facilitate adhesion of the first clear plastic layer 4 to the bifurcated foil layer 3 and the wire grid 5 to the first clear plastic layer 4. The first clear plastic layer 4 comprises apertures 16 that are used to secure the corrugated plastic layer (and the other layers on top of it) to the hard plastic backing 1.

The next layer is the wire grid 5. This layer comprises a plurality of horizontal wires 17 and a plurality of vertical wires 18. The horizontal wires 17 extend beyond the edge of the first clear plastic layer 4 so that they come into contact with the bifurcated foil layer 3. The vertical wires 18 end short of the clear plastic layer 4 so that they do not come into contact with the bifurcated foil layer 3 at all. As discussed more fully below, the purpose of the wire grid 5 is to conduct electricity across the surface of the target when the carbon tape 6 is energized.

The carbon tape 6 preferably runs from the bottom of the target to the top, along the outer edges of the target. As discussed in connection with FIG. 3, each strip of carbon tape 6 is connected to a power lead 33. When voltage is applied to the power lead 33, electricity is conducted along the carbon tape 6, which is in contact with the outer ends of the horizontal wires 17 of the wire grid 5. In this manner, the wire grid 5 is energized. Because the carbon tape 6 and the horizontal wires 17 of the wire grid 5 are also in contact with the bifurcated foil layer 3, both halves of the aluminum foil layer serve to spread the heat out across the surface of the target without leaving gaps between wires.

In a preferred embodiment, the corrugated plastic layer 2 is secured to the hard plastic backing 1 with rivets (see FIG. 7B) and the first ends 23 of the power lead 33 attached to the carbon tape 6 (see FIG. 3) before the next layer is applied. The next layer is a second clear plastic layer 7; as noted above, this layer is used only during the manufacturing process and is removed prior to installation of the front cover sheet 8. This layer is the same length as the aluminum foil layer, and in one embodiment, the second clear plastic layer is roughly as wide as the first clear plastic layer 4. Thus, a portion of the carbon tape 6 extends beyond the second clear plastic layer 7, but this is not necessary for any functional reason (it may simply be easier from a manufacturing standpoint to cut the first and second clear plastic layers so that they are the same size). The second clear plastic layer 7 could be the same width as the bifurcated foil layer 3. The second clear plastic layer 7 is preferably non-adhesive on either side, and it is secured in place by the adhesive on the first clear plastic layer 4. The purpose of the second clear plastic layer 7 is to prevent debris from sticking to the assembly (including the first clear plastic layer 4 and the carbon tape 6) during handling and/or storage.

The next layer is the front cover sheet 8. The front cover sheet 8 is preferably comprised of vinyl with an adhesive on one side that allows the front cover sheet 8 to be adhered to the assembly (the "assembly" being the corrugated plastic layer 2, the bifurcated foil layer 3, the first clear plastic layer 4, the wire grid 5, and the carbon tape 6 but excluding the second clear plastic layer 7). The front cover sheet 8 may comprise an image of a friendly soldier, an enemy combatant, or it may be a solid color. The front cover sheet 8 allows the target to be used to provide an image for visual non-assisted (non-thermal) identification.

An optional silhouette accessory 9 may be adhered to the front cover sheet 8 (see FIG. 10) of the target. The purpose of the silhouette accessory 9 is to create a silhouette of a weapon or other piece of equipment within the heat signature created by the target. Although the silhouette accessory is depicted in the figures as an AK47 assault rifle, it could be in the shape of any other weapon or piece of equipment typically carried by soldiers or combatants. In this manner, soldiers can be trained to recognize friendly soldiers or enemy combatants based on the silhouettes of their weapons and/or equipment within their respective heat signatures.

Figure 2:
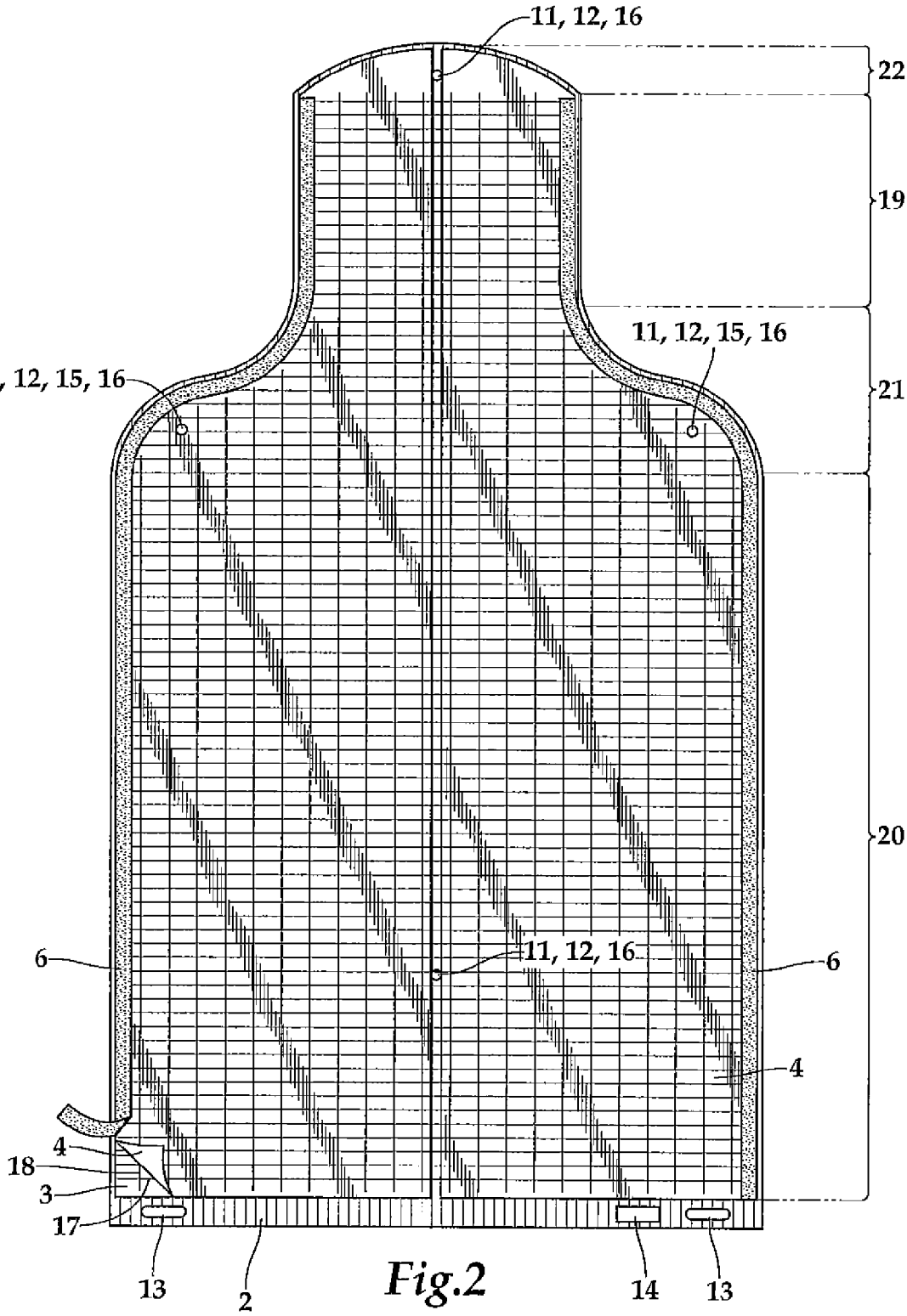
FIG. 2 is a front view of the present invention with the target assembled but without the hard plastic backing or front cover sheet.

FIG. 2 is a front view of the present invention with the target assembled but without the hard plastic backing or front cover sheet. This figure shows the apertures 11, 12, 15 and 16 that allow the corrugated plastic layer 2 is be secured to the hard plastic backing 1. It also shows the wire grid 5, which is comprised of a plurality of horizontal wires 17 disposed parallel to one another and a plurality of vertical wires 18 disposed parallel to one another. In a preferred embodiment, the vertical wires 18 are positioned on top of the horizontal wires 17 so that the horizontal wires 17 are closest to the bifurcated foil layer 3. In a preferred embodiment, the horizontal wires 17 are approximately one-half inch apart, and the vertical wires 18 are approximately one inch apart. Preferably, the vertical wires 18 of the wire grid 5 never touch the carbon tape 6. As noted above, the horizontal wires 17, on the other hand, come into contact with the carbon tape 6 and the outer edges of the bifurcated foil layer 3.

In a preferred embodiment, the wire grid 5 is constructed so as to provide different heating zones within the target. As is known in the art, the electrical resistance of a wire is affected by the wire's diameter, length, and the type of metal or metal alloy used to fabricate the wire. In the present invention, the length of horizontal wire 17 is dictated by the shape of the target. The diameter, however, can be adjusted. In a preferred embodiment, the wire grid 5 comprises a head zone 19, a body zone 20, and a shoulder zone 21. In a preferred embodiment, the target further comprises a cap zone 22 that contains no horizontal wires and to which none of the vertical wires extends.

In a preferred embodiment, all of the horizontal wires 17 are preferably comprised of the same metal alloy, namely, an alloy of nickel and chrome. One such alloy is NIKROTHAL 60™ manufactured by Sandvik AB of Sandviken, Sweden. In a preferred embodiment, the horizontal wires of the head zone 20 are 47 gauge (0.0014 inches in diameter), the horizontal wires of the shoulder zone 22 are 45 gauge (0.00175 inches in diameter), and the horizontal wires of the body zone 21 are 44 gauge (0.002 inches in diameter). By adjusting the diameter of the wires in the head, shoulder and body zones in relation to the length of the wires, a target is provided that will emit greater heat in the head area, less heat in the body area, and still less heat in the shoulder area. No heat is emitted in the cap area.

The vertical wires 18 preferably have a greater diameter than all of the horizontal wires 17 so that they will conduct electricity without heating up (i.e., they are preferably less resistant than the horizontal wires 17). In a preferred embodiment, the vertical wires 18 are 38 gauge (0.004 inches in diameter), and they are comprised of an alloy of copper and nickel. One such alloy is CUPROTHAL 49™ manufactured by Sandvik AB of Sandviken, Sweden. The vertical wires are not connected to a power source, and their only function is to provide a path around a broken horizontal wire.

In a preferred embodiment, the wires 17, 18 that comprise the wire grid 5 comprise less than two percent (2%) of the entire front surface of the target. The wire grid 5 is constructed to provide maximum survivability to the target. In tests involving the present invention, the target was hit by 1600 bullets and still continued functioning. The reason the target is able to survive this many hits is because if a horizontal wire is broken, the electrical current may travel up one of the vertical wires and across an adjacent horizontal wire. The only way the target would become completely dysfunctional is if all (or a significant portion) of the horizontal wires were broken at the point at which they cross from one half of the bifurcated foil layer 3 to the other. The odds of that happening are virtually nil.

Figure 3:
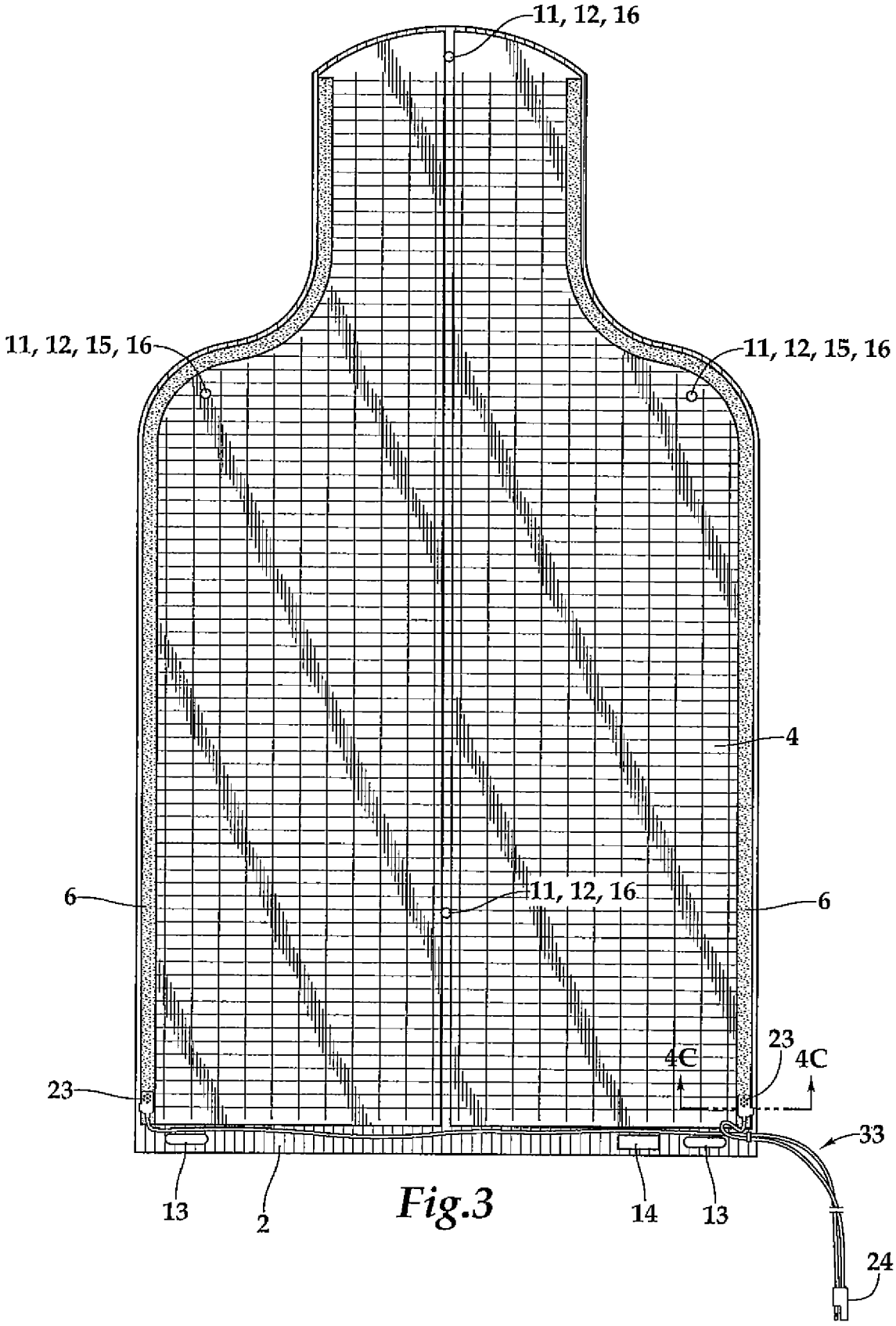
FIG. 3 is a front view of the present invention with the target assembled but without the hard plastic backing or front cover sheet and with the power lead installed on the target.

FIG. 3 is a front view of the present invention with the target assembled but without the hard plastic backing or front cover sheet and with the power lead 33 installed on the target. This figure is the same as FIG. 2, except that it shows the power lead 33 attached to the bottom end of each strip of carbon tape 6. In a preferred embodiment, the power lead 33 comprises two first ends 23 (see FIG. 4A), each of which is crimped around the bottom end of the carbon tape. Note that the first ends 23 of the power lead 33 could be attached (or crimped) directly to the bifurcated foil layer 3, but that would not be as effective as attaching them directly to the carbon tape 6.

The first end 23 of the power lead 33 is preferably comprised of tin so that it will not react with the aluminum foil. The first end 23 preferably comprises teeth (shown in FIG. 4A) that punch through the aluminum foil. The second end 24 of the power lead 33 (see FIG. 4B) is preferably stowed in the cut-out 14 in the corrugated plastic layer 2 when not in use (see FIG. 4D). The second end 24 is a connector plug that connects to a power source. The power source may be any electrical power device, such as a battery or transformer, and the power can be alternating current (AC) or direct current (DC). The transformer may be used in connection with a controller that allows the voltage flowing to the wire grid to be adjusted. In a preferred embodiment, the voltage input does not exceed 24 volts.

Figure 4C:
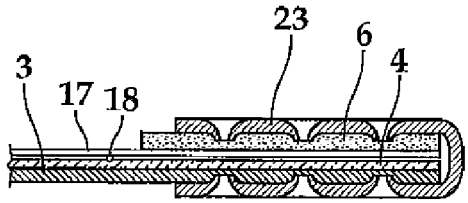
FIG. 4C is a section view of the power lead installed on the target.
Figure 4B:
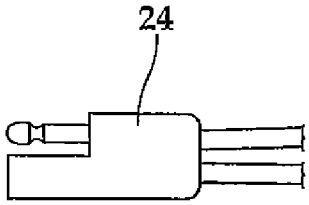
FIG. 4B is a detail view of a second end of the power lead of the present invention.
Figure 4D:
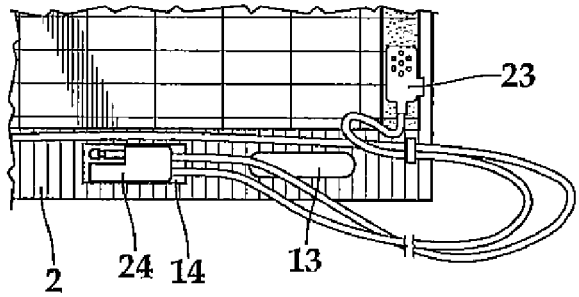
FIG. 4D is a detail view of the second end of the power lead secured in a cut-out in the corrugated plastic layer.

FIG. 4C shows the first end 23 of the power lead 33, the carbon tape 6, the horizontal wire(s) 17, the first clear plastic layer 4, and one half of the bifurcated foil layer 3. As shown in FIG. 3, the power lead 33 preferably comprises two first ends 23 and one second end 24. One of the first ends (in this case, shown on the right-hand side of the figure) provides voltage to the wire grid, and the other first end (case, shown on the left-hand side of the figure) allows for voltage to flow out of the wire grid, thereby completing the circuit. The fact that the horizontal wires 17 extend all the way across the front surface of the target and come into contact with each of the strips of carbon tape 6 allows the electrical circuit to be completed.

Figure 5:
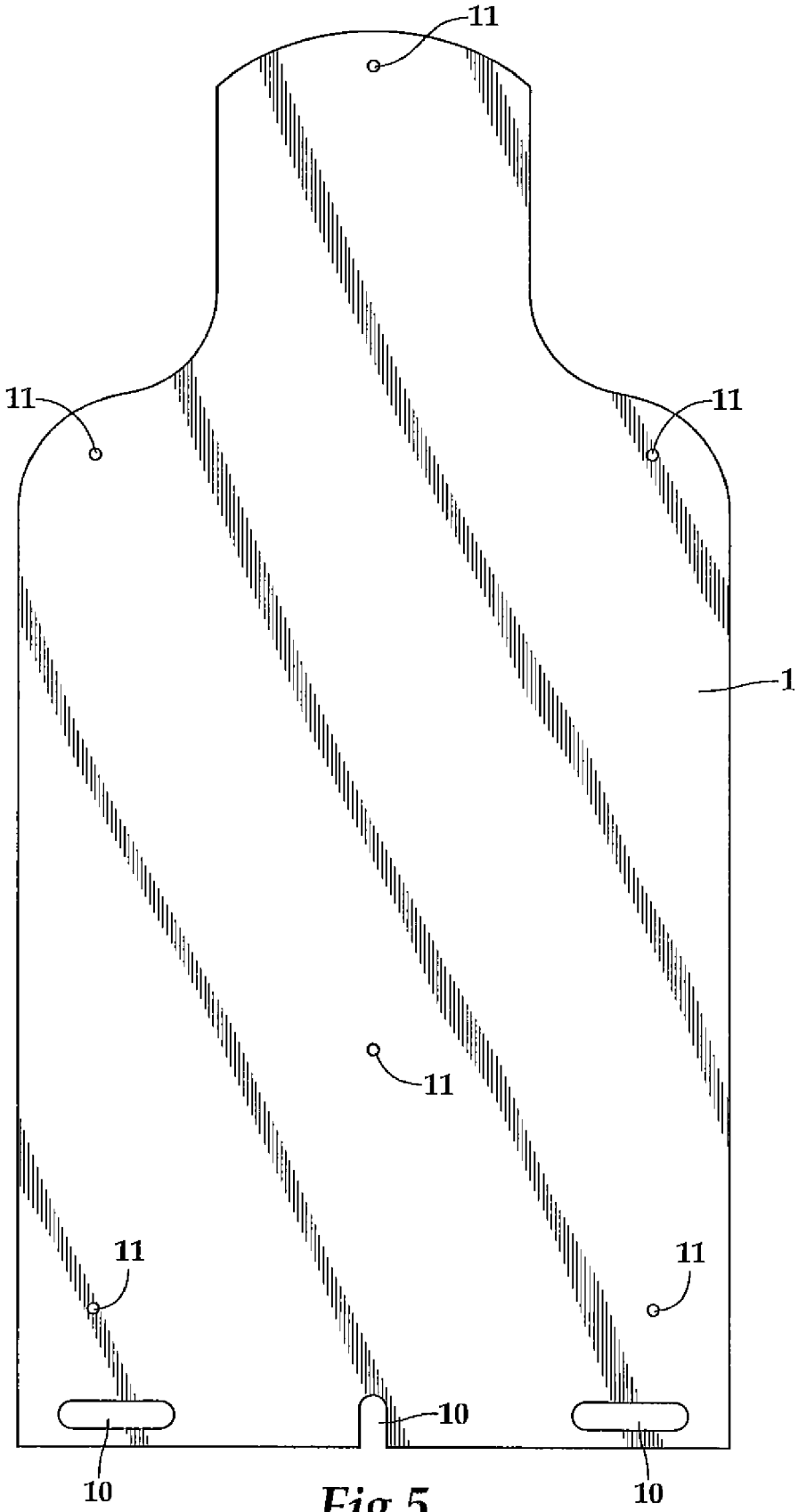
FIG. 5 is a front view of the hard plastic backing of the present invention.

FIG. 5 is a front view of the hard plastic backing of the present invention. The purpose of the hard plastic backing 1 was discussed in connection with FIG. 1.

Figure 7A:
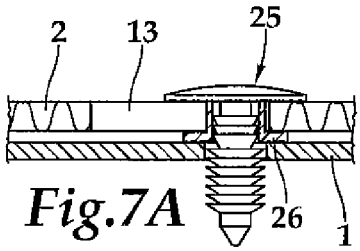
FIG. 7A is a detail view of a first rivet used to attach the corrugated plastic layer to the hard plastic backing.
Figure 6:
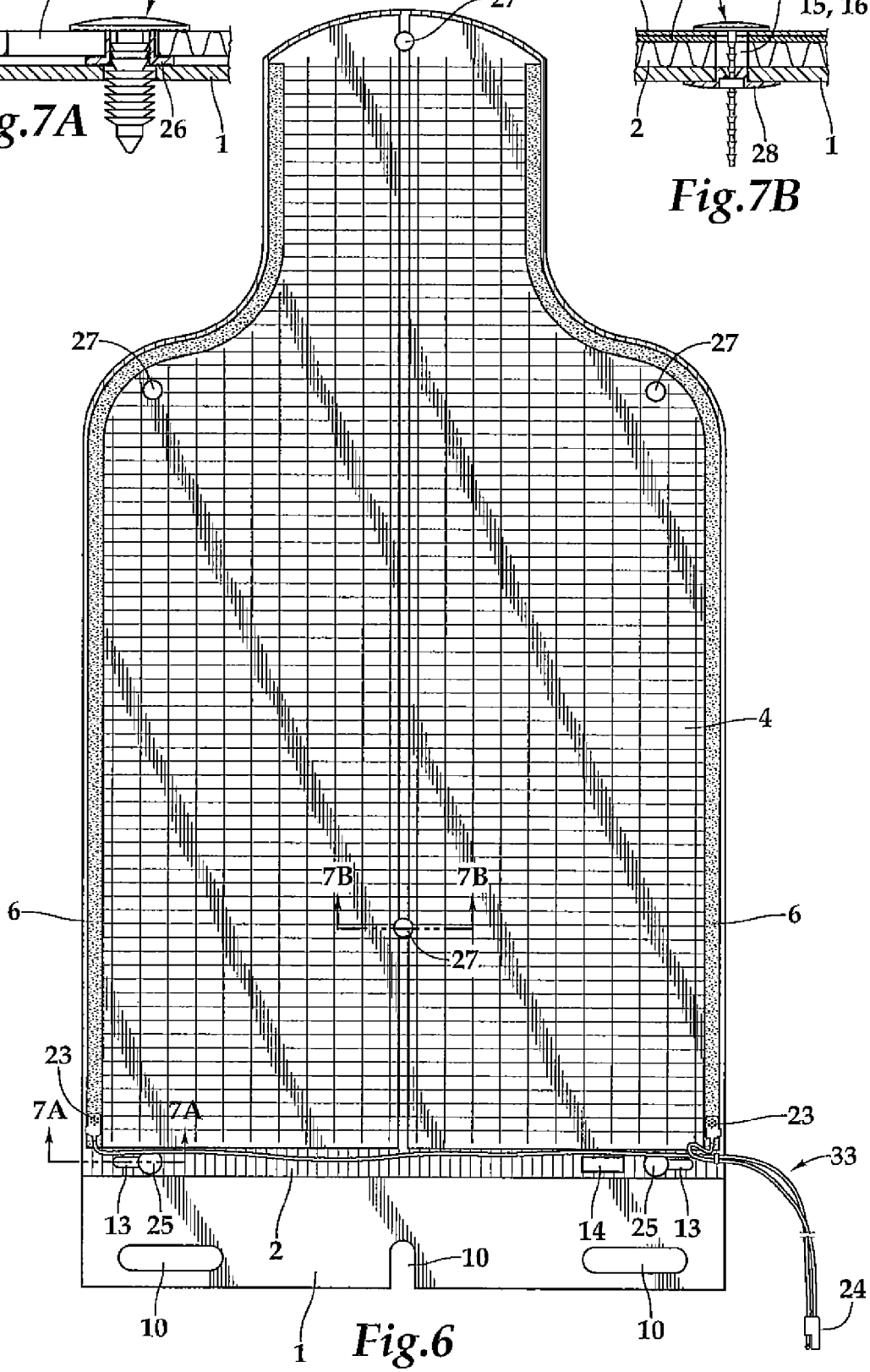
FIG. 6 is a front view of the present invention with the hard plastic backing but without the front cover sheet.

FIG. 6 is a front view of the present invention with the hard plastic backing but without the front cover sheet. This figure illustrates one method of attaching the corrugated plastic layer 2 to the hard plastic backing 1, but the present invention is not limited to any particular method of attachment. In this example, first rivets 25 (see FIG. 7A) extend through the cut-outs 13 in the corrugated plastic layer 2 and through the hard plastic backing 1. A separate spacer component 26 encircles the shaft of the rivet and is situated between the corrugated plastic layer 2 and the hard plastic backing 1. The purpose of the spacer component 26 is to allow the first rivet 25 to slide laterally (right to left and vice versa) within the cut-out 13. This lateral movement is necessary so that the target can be bent vertically (i.e., curved slightly to resemble a three-dimensional figure) to fit into a target lift device. As the target is bent, the first rivets 25 move slightly to the right within the cut-outs 13.

Figure 7B:
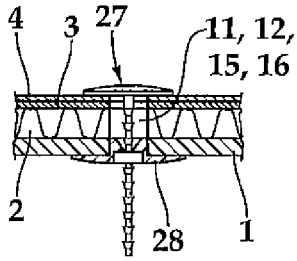
FIG. 7B is a detail view of a second rivet used to attach the corrugated plastic layer to the hard plastic backing.

Second rivets 27 and rivet backings 28 are used to secure the plastic corrugated layer 2 to the hard plastic backing 1 at apertures 11, 12, 15 and 16. As shown in FIG. 7B, the second rivet 27 extends through the first clear plastic layer 4, the bifurcated aluminum foil, if applicable (the two second rivets located on the central axis of the target do not actually extend through the aluminum foil but through the space between the two halves of the foil), the corrugated plastic layer 2 and the hard plastic backing 1.

Figure 8:
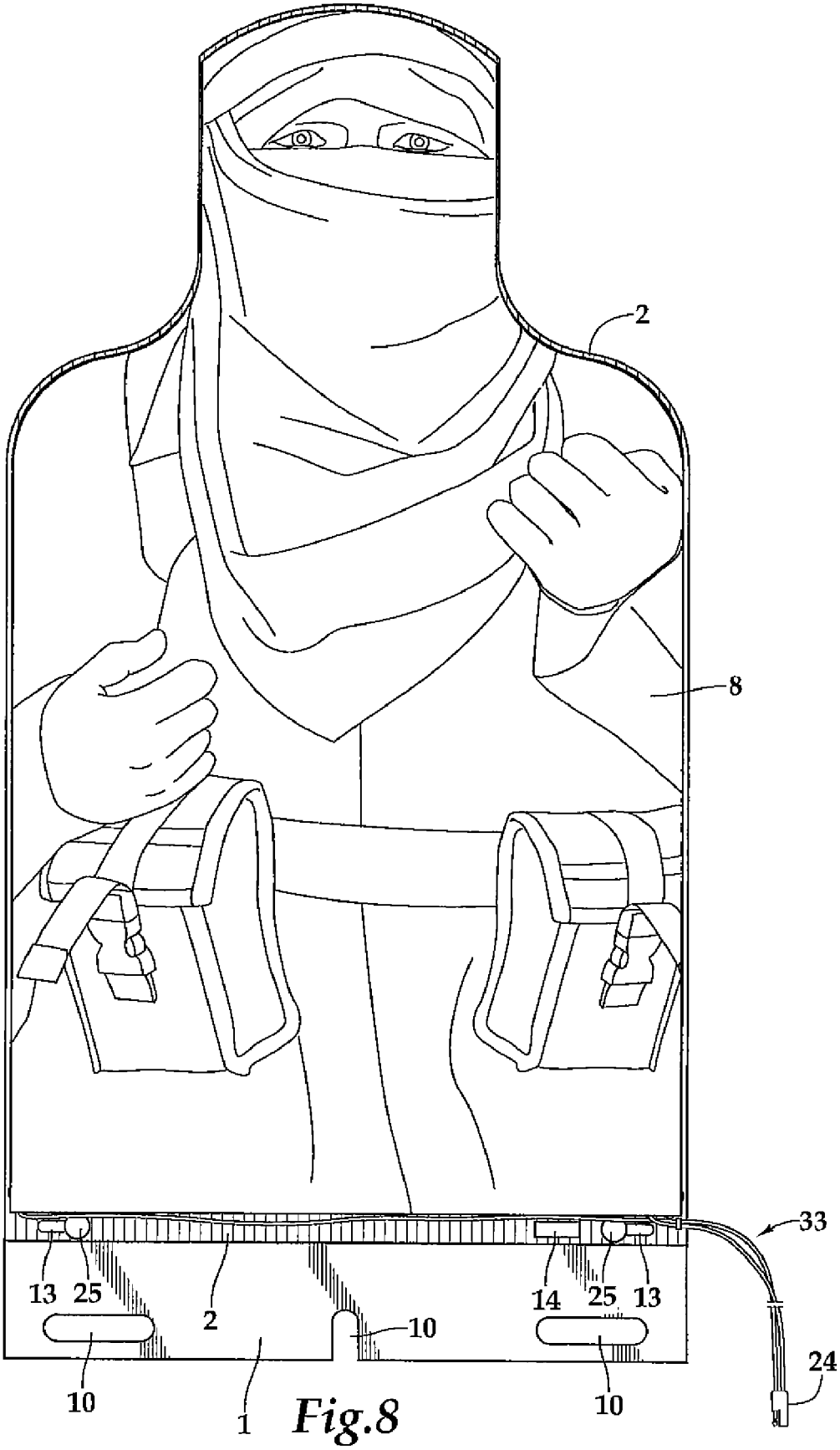
FIG. 8 is a front view of the present invention with the hard plastic backing and the front cover sheet.

FIG. 8 is a front view of the present invention with the hard plastic backing and the front cover sheet. As noted above, the front cover sheet 8 is simply adhered to the assembly.

Figure 9:
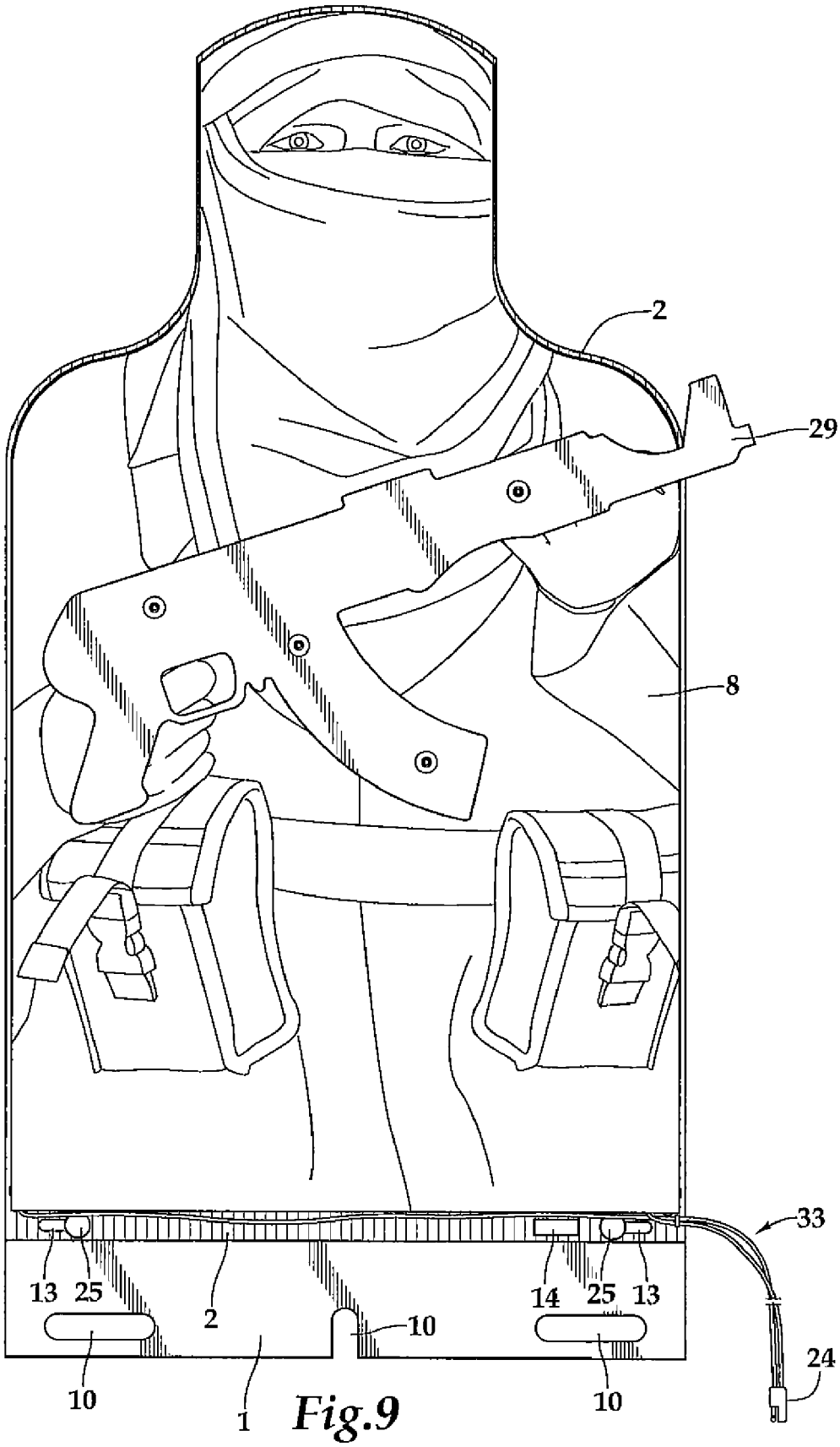
FIG. 9 is a front view of the present invention with the hard plastic backing, the front cover sheet, and a silhouette accessory.

FIG. 9 is a front view of the present invention with the hard plastic backing, the front cover sheet, and a silhouette accessory. The silhouette accessory 29 creates a silhouette in the shape of the silhouette accessory 29 within the heat signature of the target. (As used herein, the term "heat signature" refers to the heat pattern that is created by the target or by an animate or inanimate object.) The purpose of the silhouette accessory is described above in connection with FIG. 1.

Figure 10:
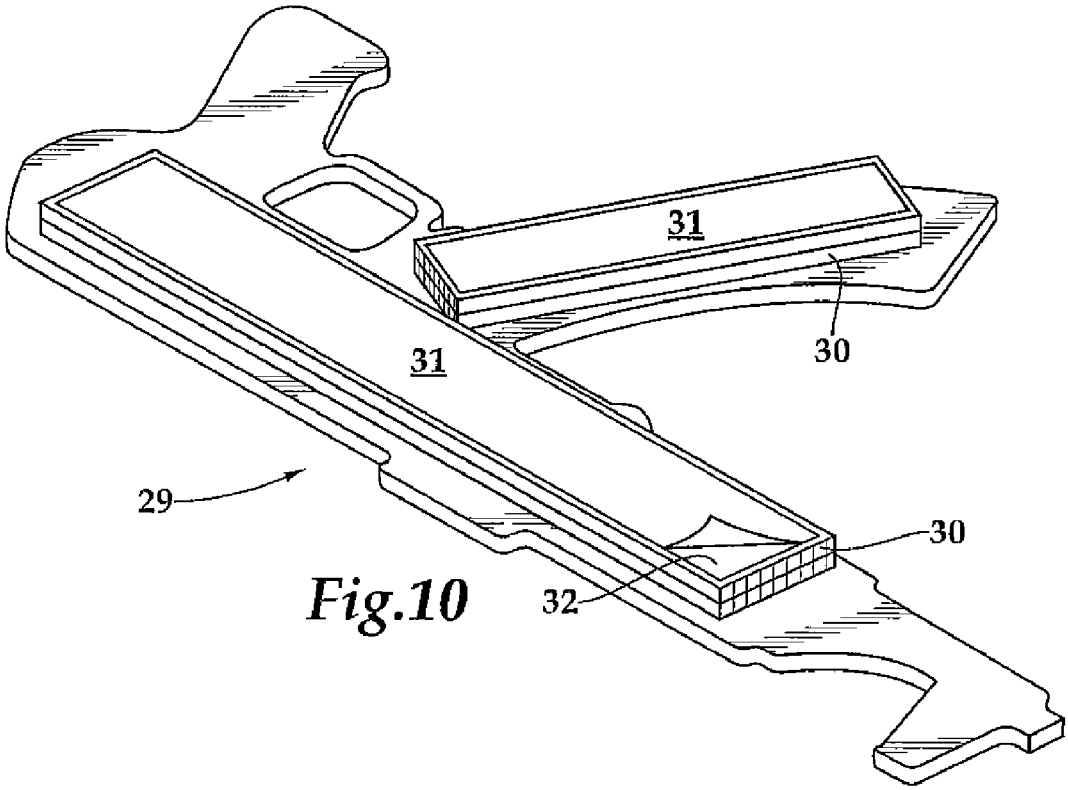
FIG. 10 is a perspective view of the silhouette accessory.

FIG. 10 is a perspective view of the silhouette accessory. As shown in this figure, the silhouette accessory 29 preferably comprises one or more thermal blocks 30 that allow the silhouette accessory 29 to be adhered to the front of the target and that provide a heat barrier between the silhouette and the target. Each thermal block preferably comprises a removable strip 31 that exposes an outer surface 32 of the thermal block 30. The outer surface 32 of the thermal block 30 preferably comprises an adhesive layer that allows the block 30 to be adhered to the front cover sheet 8.

Figure 11:
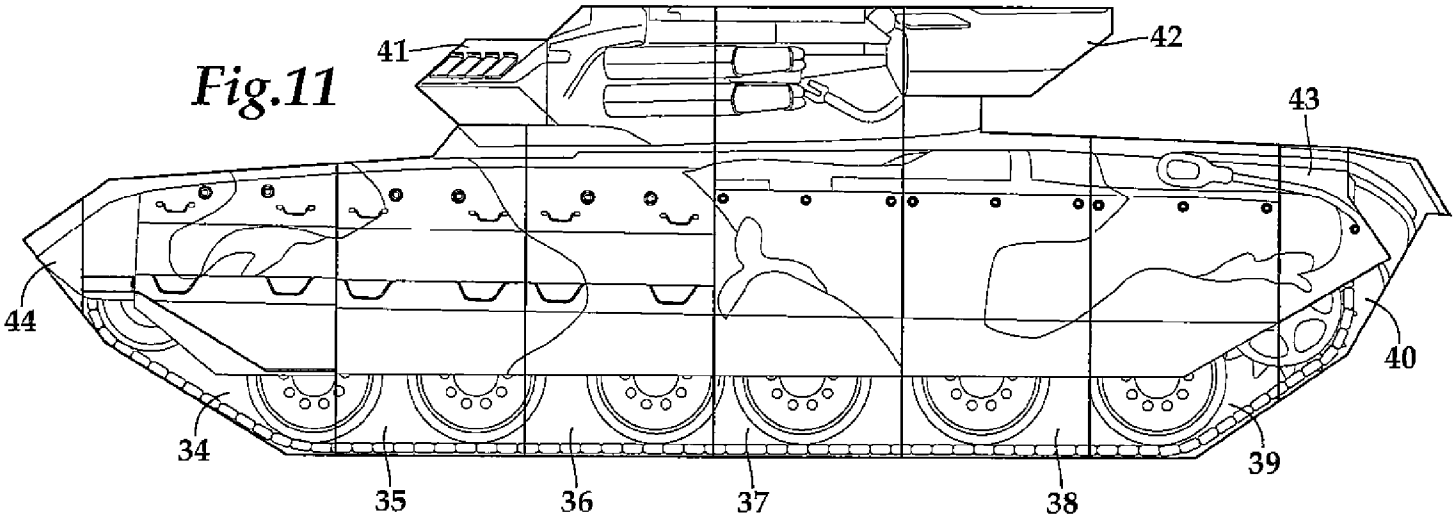
FIG. 11 is a front view of a vehicle target embodiment of the present invention.

FIG. 11 is a front view of a vehicle target embodiment of the present invention. This figure shows the left flank view of a Russian T80U tank; however, the present invention is not limited to any particular type of vehicle. The Russian T80U is shown in this and the subsequent figures for illustrative purposes, but the design principles discussed herein would apply to any type of vehicle target.

Figure 12:
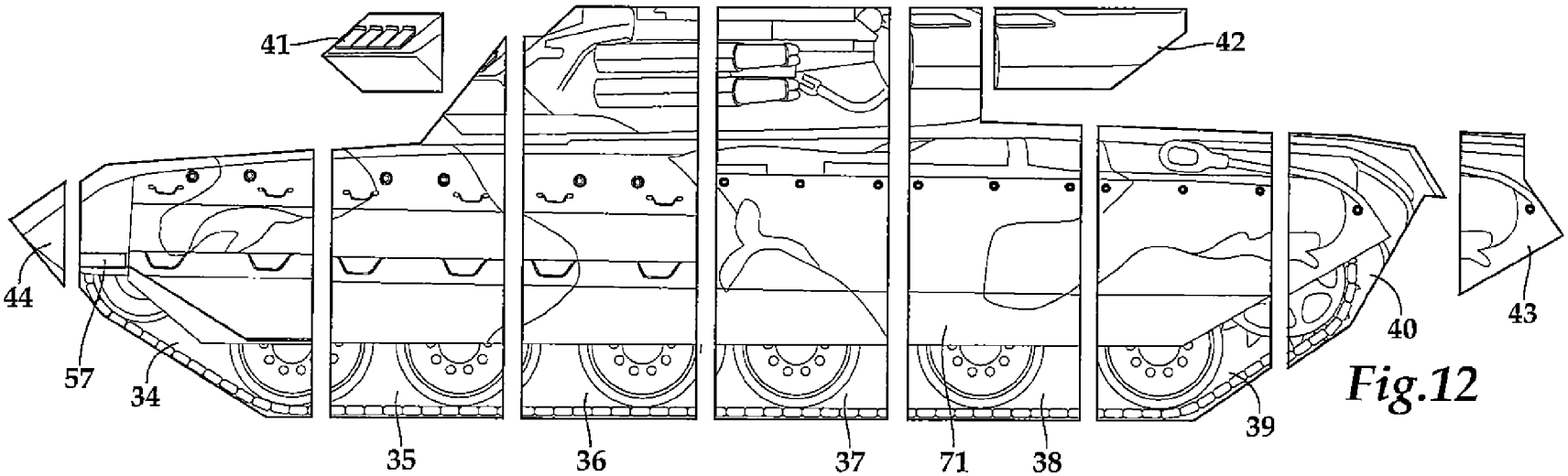
FIG. 12 is a front exploded view of the various heater and non-heater components of the vehicle target embodiment of the present invention.

As shown in FIG. 12, the vehicle target of FIG. 11 is actually comprised of seven separate parts (also referred to herein as "sections"), each of which comprises one or more heaters, three vehicle overlays, and one vehicle nose piece. The seven separate parts are indicated with reference numbers 34, 35, 36, 37, 38, 39 and 40. The three vehicle overlays are indicated with reference numbers 41, 42 and 43. The vehicle nose piece is indicated with reference number 44; in this example, the vehicle nose piece is neither a heater nor an overlay.

Figure 34:
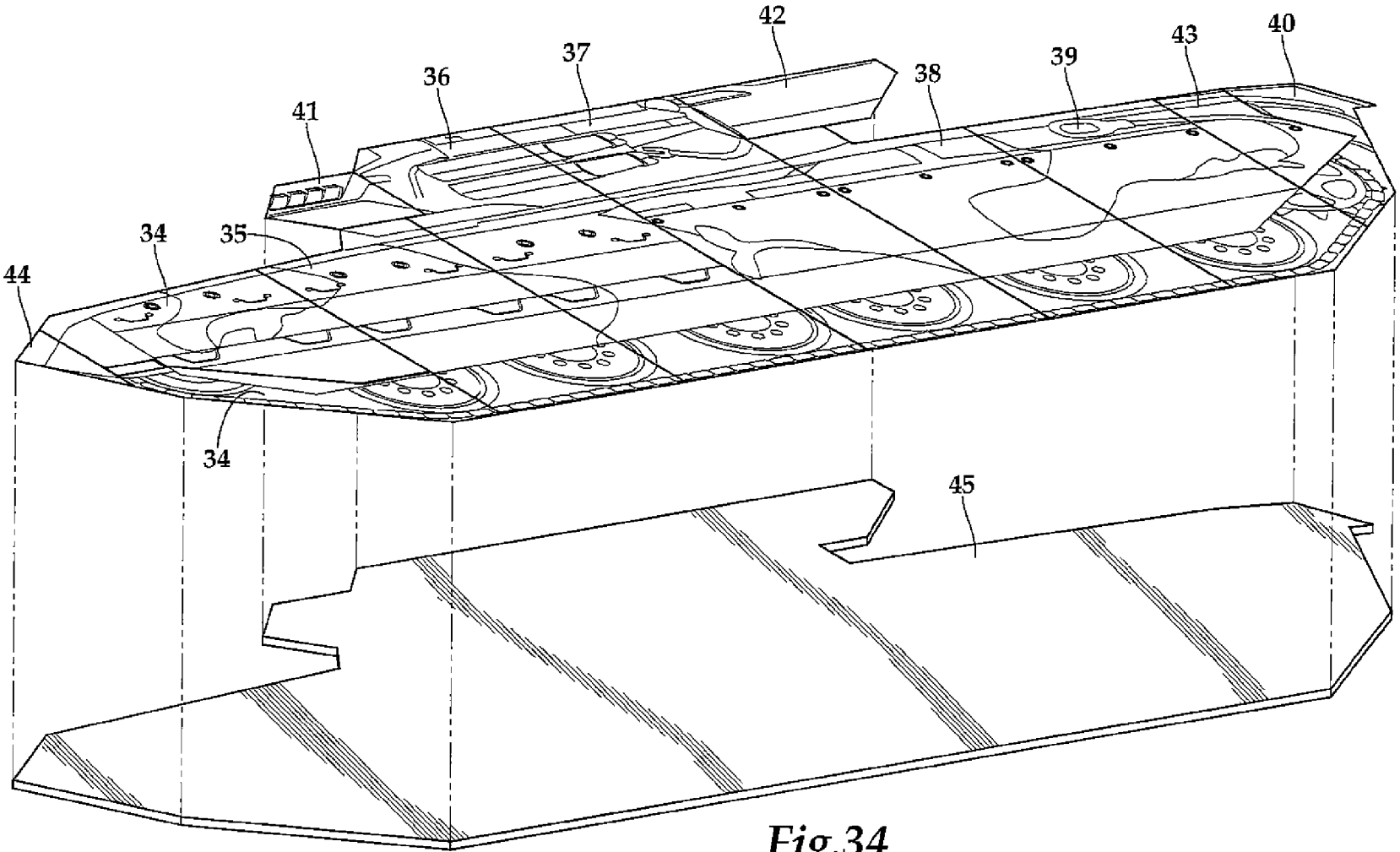
FIG. 34 is an exploded perspective view of the vehicle target on a rigid (plywood) backing.

The purpose of the vehicle heater of the present invention is to emulate the heat signature of a particular vehicle. Thus, a series of individual heaters, each comprising a plurality of vertical and horizontal wires as in the human target described above, is affixed to a backing of plywood or other suitable rigid material in the shape of whichever view (side, front, rear, etc.) is being emulated. This rigid backing 45 is shown in FIG. 34. The rigid backing 45 may be in the exact shape of the vehicle target (i.e., the outline of the target shown in FIG. 11), or it may be larger than the vehicle target. The rigid backing 45 would not likely be smaller than the vehicle target, however, because it provides the support for the target. The rigid backing 45 may be attached to a target lift device.

Figure 13:
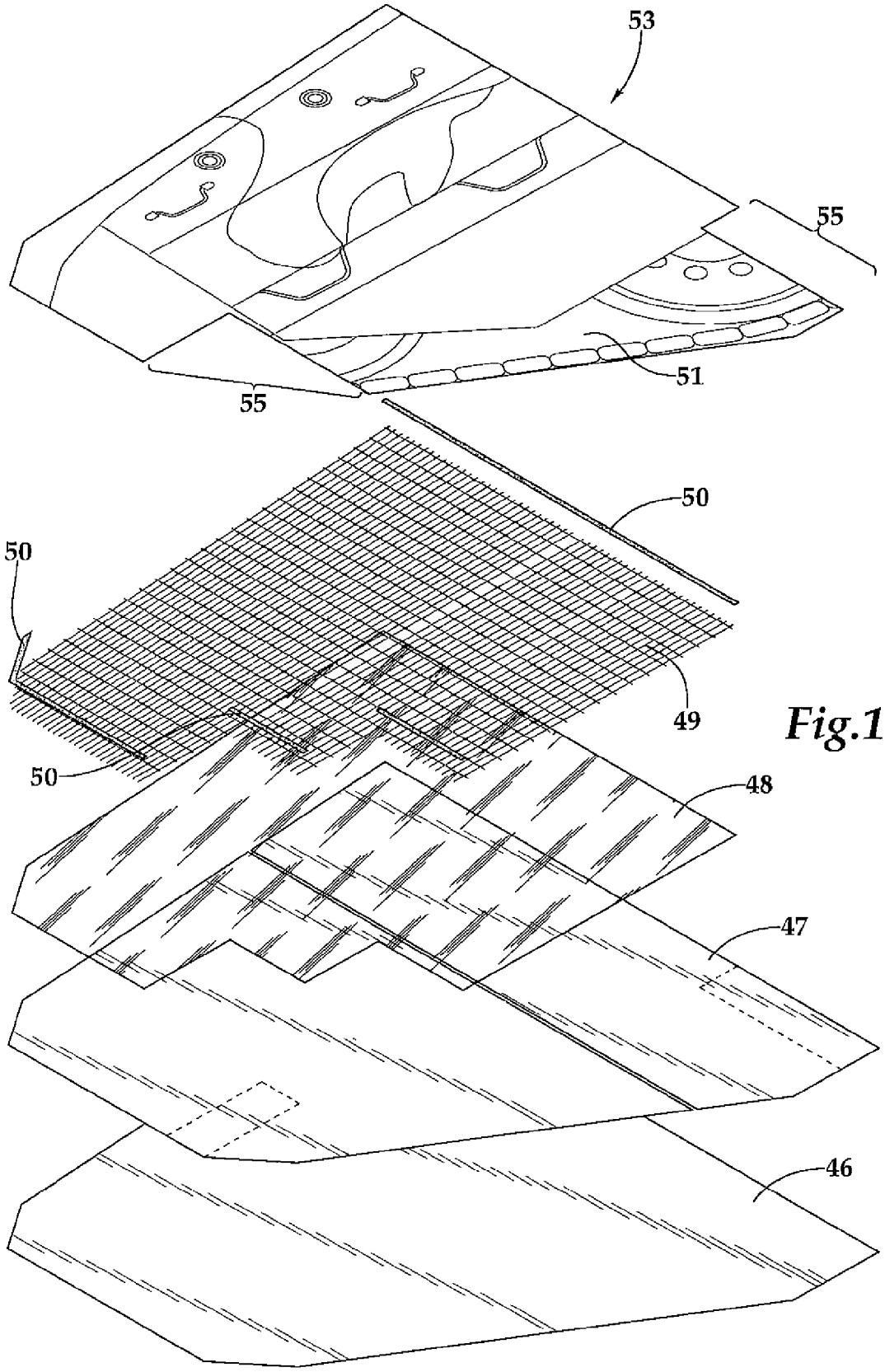
FIG. 13 is an exploded perspective view of the various layers included in the first heater of the first part of the vehicle target shown in FIG. 12.

FIG. 13 is an exploded perspective view of the various layers included in the first heater of the first part of the vehicle target shown in FIG. 12. The first heater 53 of the vehicle target is selected by way of example; however, the same layers are used in each of the other parts (reference numbers 35-40) of the vehicle target. Each of the other vehicle parts comprises a single heater; however, the first part 34 comprises two heaters 53, 54.

The vehicle target heaters differ from the human target heaters described above in that they do not incorporate a hard plastic backing 1, nor do they have a corrugated plastic layer 2. Instead of the corrugated plastic layer 2, each vehicle target heater comprises a layer of insulating material, preferably polycarbonate film 46. In a preferred embodiment, the polycarbonate film is LEXAN™ brand manufactured by SABIC Innovative Plastics IP B.V. Company of Bergen OP Zoom, Netherlands. Next are a layer of bifurcated metallic foil 47, preferably aluminum, a layer of plastic 48, preferably but not necessarily clear (transparent), the wire grid 49, carbon tape 50, and a front cover sheet 51 that serves as a graphic overlay.

In this example, there could be separate front cover sheets 51 for each of the parts of the vehicle target, or there could be a single graphic overlay 51 that lies across the entire span of the vehicle target shown in FIG. 1. In this and the previous figure (and also in FIG. 11 to the extent it shows vertical lines between the vehicle target parts), the front cover sheets 51 are shown as separate pieces, but they could also constitute a single front cover sheet covering the entire front surface of the vehicle target. As with the human targets, the front cover sheets are preferably comprised of vinyl with an adhesive backing.

The polycarbonate film 46 serves the same purpose as the corrugated plastic layer 2 of the human targets, that is, it acts as an insulating layer. Polycarbonate film 46 is preferred for the vehicle targets due to weight restrictions.

The bifurcated foil layer 47 serves the same purpose as the bifurcated foil layer of the human targets, that is, it acts to conduct (or spread) the heat conveyed by the horizontal and vertical wires of the wire grid 49. As in the human targets, the plastic layer 48 is smaller (narrower and/or shorter, depending on the configuration of the vehicle heater involved) than the bifurcated foil layer 47 to allow the horizontal wires of the wire grid 49 to come into contact with the foil only at the outer edges of the foil layer where there is carbon tape 50. Preferably, the vertical wires never touch the carbon tape and do not come into contact with the foil layer at all.

The wire grid 49 of each vehicle target heater comprises a plurality of horizontal and vertical wires (or elements); however, as shown in subsequent figures, the horizontal wires may be slanted or angled to accommodate to accommodate different shapes of heaters. The vertical wires are all preferably a constant distance apart; in the examples shown in the figures, the vertical wires are all 2.0 inches apart. The spacing between horizontal wires is determined so as to generate the desired wattage within the heating zone at issue. In addition, each horizontal element may actually be comprised of multiple wires spun around a fiberglass strand to achieve a desired resistance per foot that best achieves a given power density for a particular area. As used herein (with respect to both the vehicle targets and the human targets), the term "horizontal wire" may also be a "horizontal element" comprised of more than one wire.

During the manufacturing, handling and storage process, a second clear plastic layer (not shown) may be used, as described above in connection with the human targets (reference number 7). This layer is not shown in the vehicle target figures, however, because it is not part of the final assembly.

In the case of the second 35, third 36, fourth 37, fifth 38, sixth 39 and seventh 40 parts of the vehicle target, the polycarbonate film 34, bifurcated foil 35 and front cover sheet 51 are all the same size (that is, unless a larger front cover sheet 51 is used to cover more than one vehicle part). As noted above, the plastic layer 48 is preferably smaller in size than these three layers. In the example provided in the figures, the polycarbonate and foil layers of the first part 34 are significantly larger than the other layers, however, because the first part 34 comprises two separate heaters (see FIG. 15), and no power leads are connected to the second heater (see FIG. 17). Thus, as explained more fully below, the oversized foil layer enables an electrical connection to be made between the first and second heaters of the first part 34 of the vehicle target. The polycarbonate layer must be at least as large as the foil layer to provide insulation between the foil layer and the rigid backing (not shown).

Figure 14:
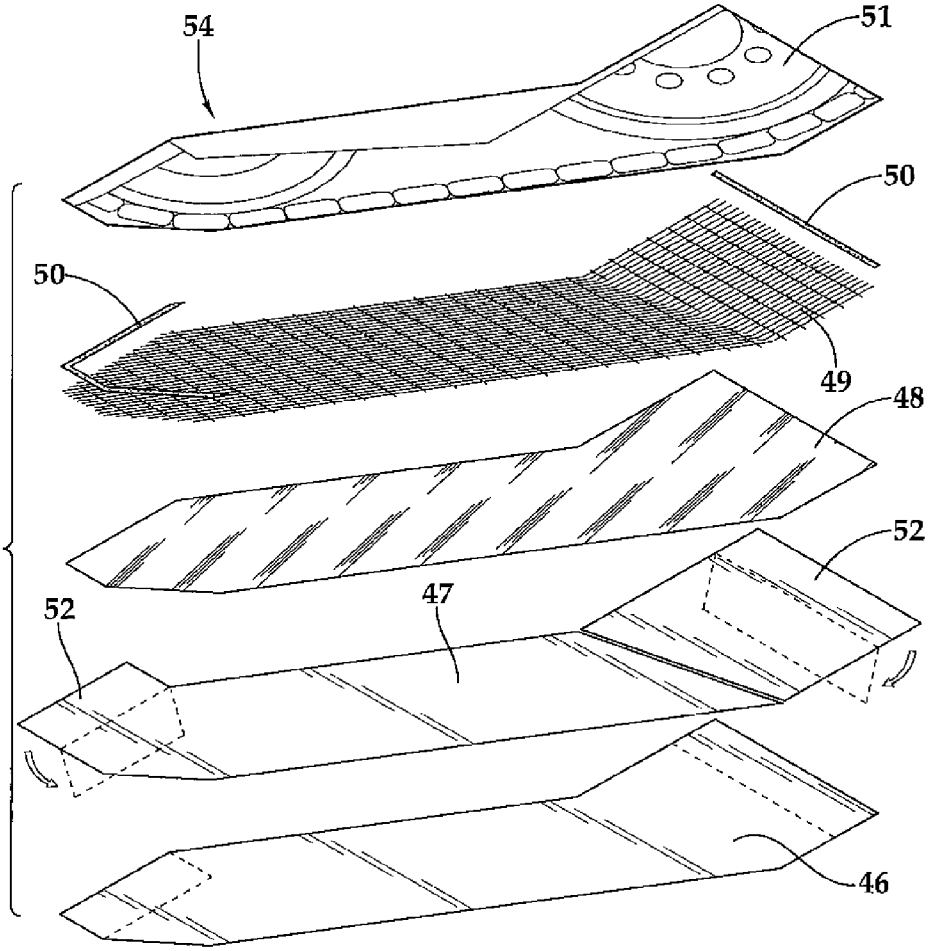
FIG. 14 is an exploded perspective view of the various layers included in the second heater of the first part of the vehicle target shown in FIG. 12.

FIG. 14 is an exploded perspective view of the various layers included in the second heater of the first part of the vehicle target shown in FIG. 12. As shown in this figure, the bifurcated foil layer 47 comprises two flaps 52 that fold over backwards and wrap around behind the polycarbonate layer 46. The dotted lines on layer 46 indicate where the foil flaps 52 would be on the underside of the polycarbonate layer 46).

Figure 15:
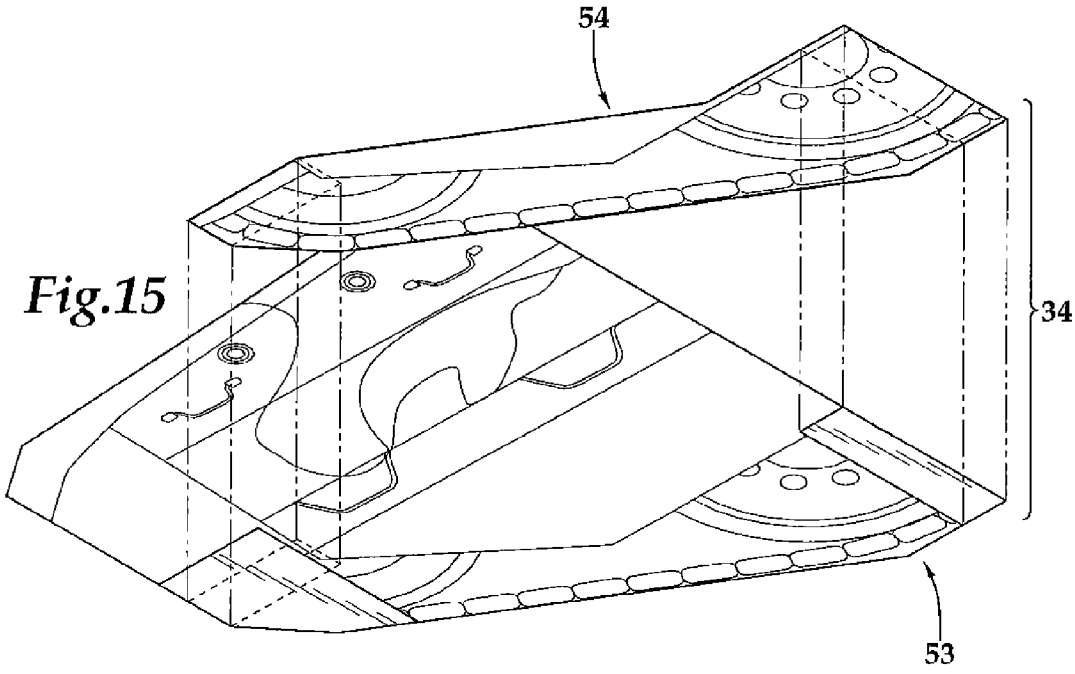
FIG. 15 is a perspective view of the first and second heaters of the first part of the vehicle target shown in FIG. 12.

FIG. 15 is a perspective view of the first and second heaters of the first part of the vehicle target shown in FIG. 12. As shown in this figure, the second heater 54 is juxtaposed onto the top of the first heater 53 when this part 34 of the vehicle target is assembled. The two foil flaps 52 on the underside of the second heater 54 will come into direct contact with the bifurcated foil layer 47 of the first heater 53, thereby making an electrical connection. Note that there are cut-outs 53 in the front cover sheet 51 of the first heater 53 to allow this contact to be made.

Figure 16:
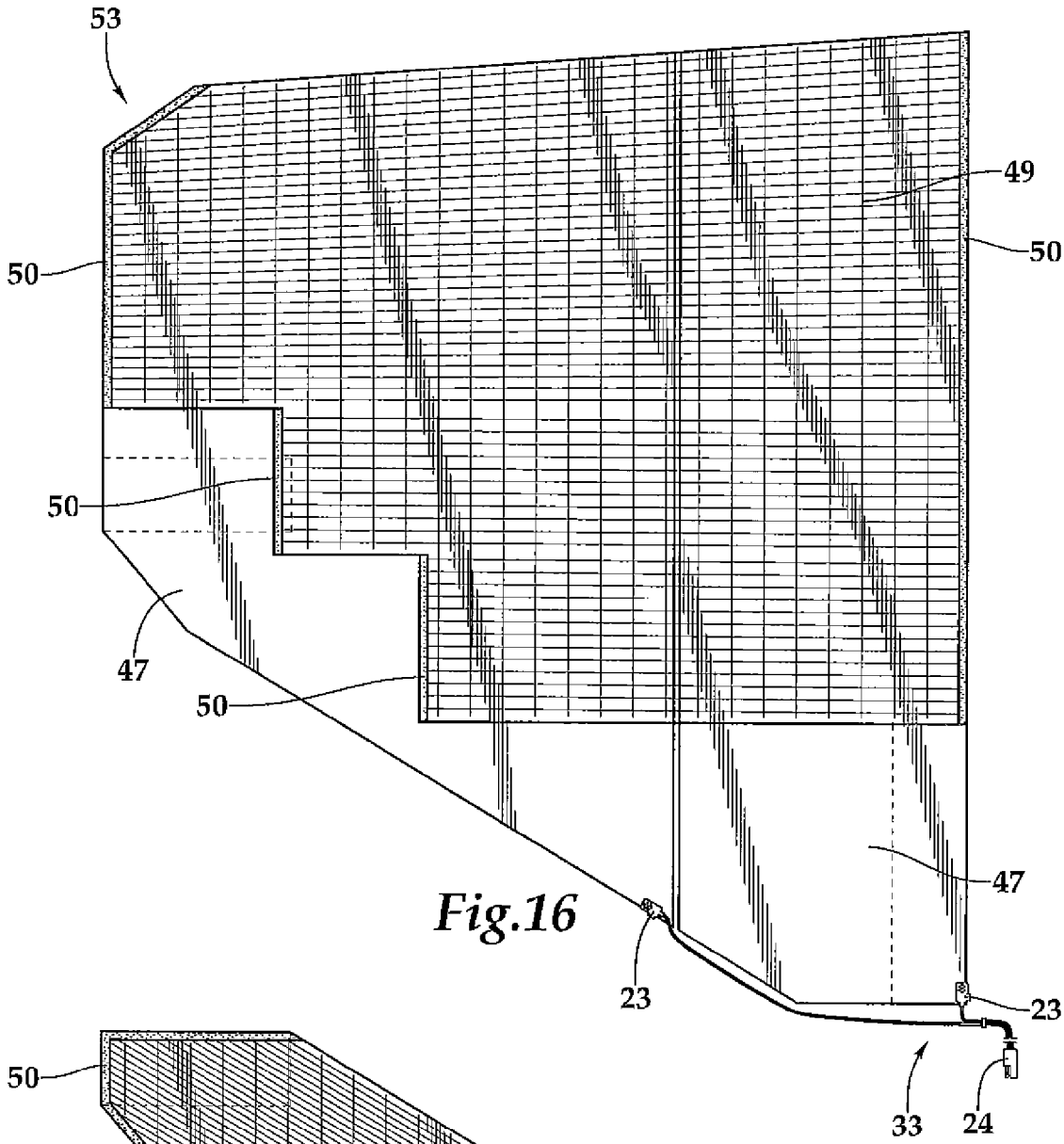
FIG. 16 is a front assembled view of the first heater of the first part of the vehicle target shown without the front cover sheet.

FIG. 16 is a front assembled view of the first heater of the first part of the vehicle target shown without the front cover sheet. As shown in this figure, the bifurcated foil layer 47 is larger than the wire grid 49 to allow for the electrical connection between the first and second heaters 53, 54. The first ends 23 of the power lead 33 are attached (crimped) directly to the foil layer 47 (one first end 23 is crimped to each side of the bifurcated foil layer 47). In the other heater examples provided herein, the first ends 34 of the power leads 33 are crimped to the carbon tape 50. The dotted lines on this figure indicate where the foil flaps 52 of the second heater 54 come into contact with the bifurcated foil layer 47 of the first heater 53 (these same dotted lines are shown in FIG. 13).

Figure 17:
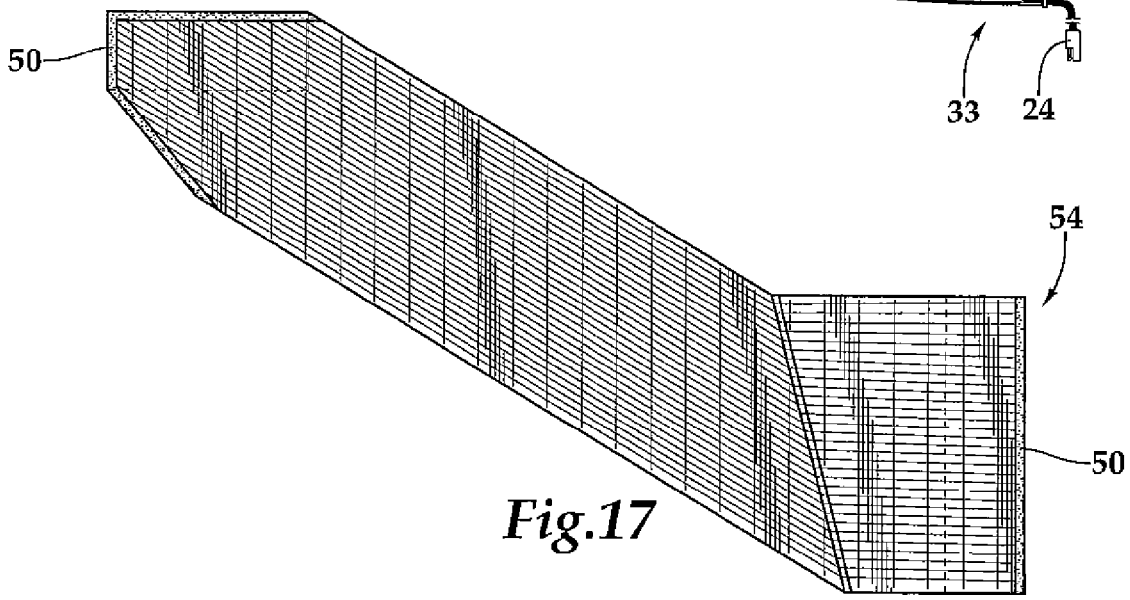
FIG. 17 is a front assembled view of the second heater of the first part of the vehicle target shown without the front cover sheet.

FIG. 17 is a front assembled view of the second heater of the first part of the vehicle target shown without the front cover sheet. The dotted lines on this figure show where the foil flaps 52 would be on the underside of this heater.

Figure 18:
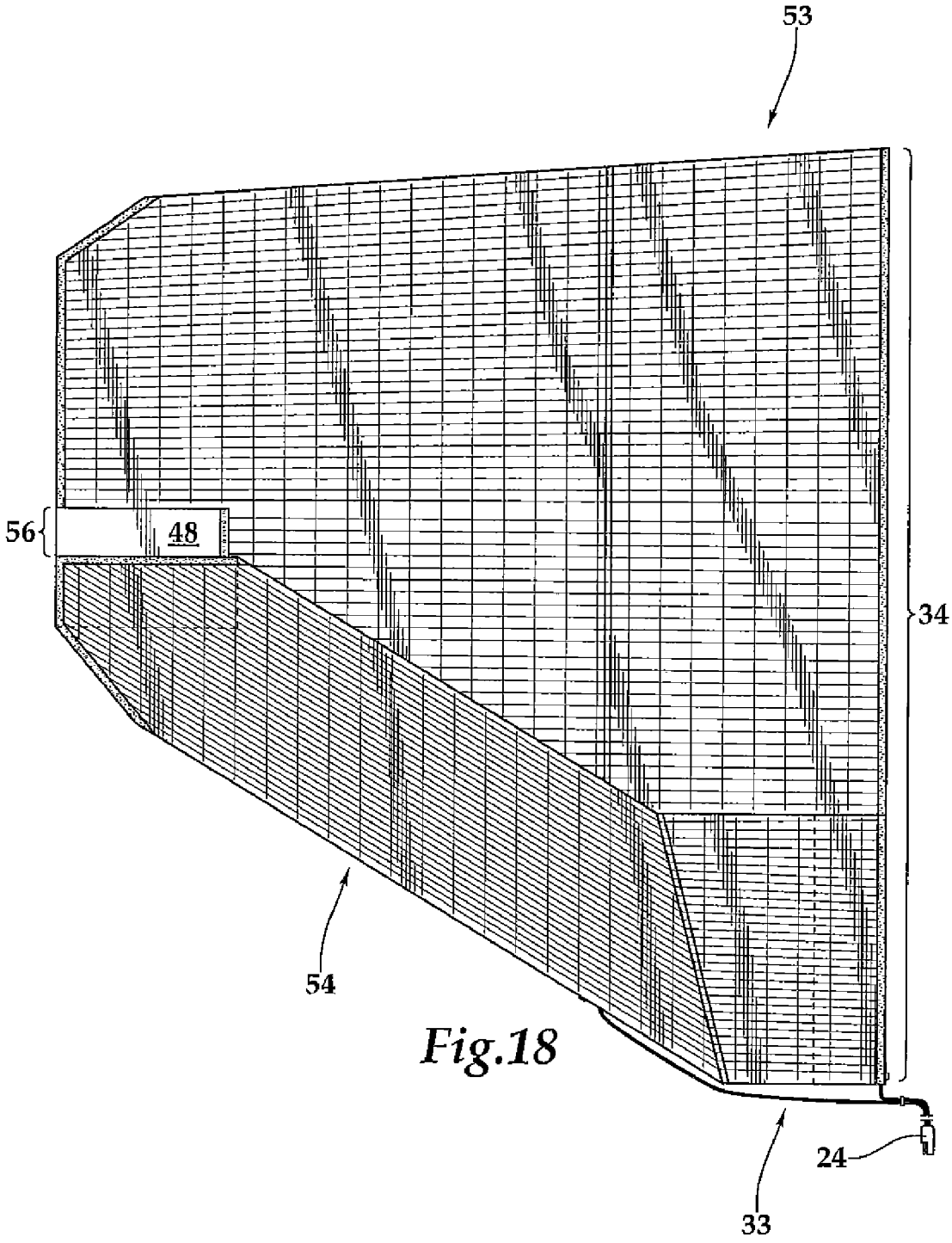
FIG. 18 is a front assembled view of the first and second heaters of the first part of the vehicle target shown without the front cover sheets.

FIG. 18 is a front assembled view of the first and second heaters of the first part of the vehicle target shown without the front cover sheets. This figure shows dotted lines where the foil flaps 52 of the second heater 54 are located on the underside of the second heater. It also shows a gap 56 between the first 53 and second heaters 54. This gap is intentional because it represents a portion 57 (see FIG. 12) of the first part 34 of the vehicle target in which relatively little is emitted (this gap 56 corresponds to a cold part on the actual tank).

Figure 19:
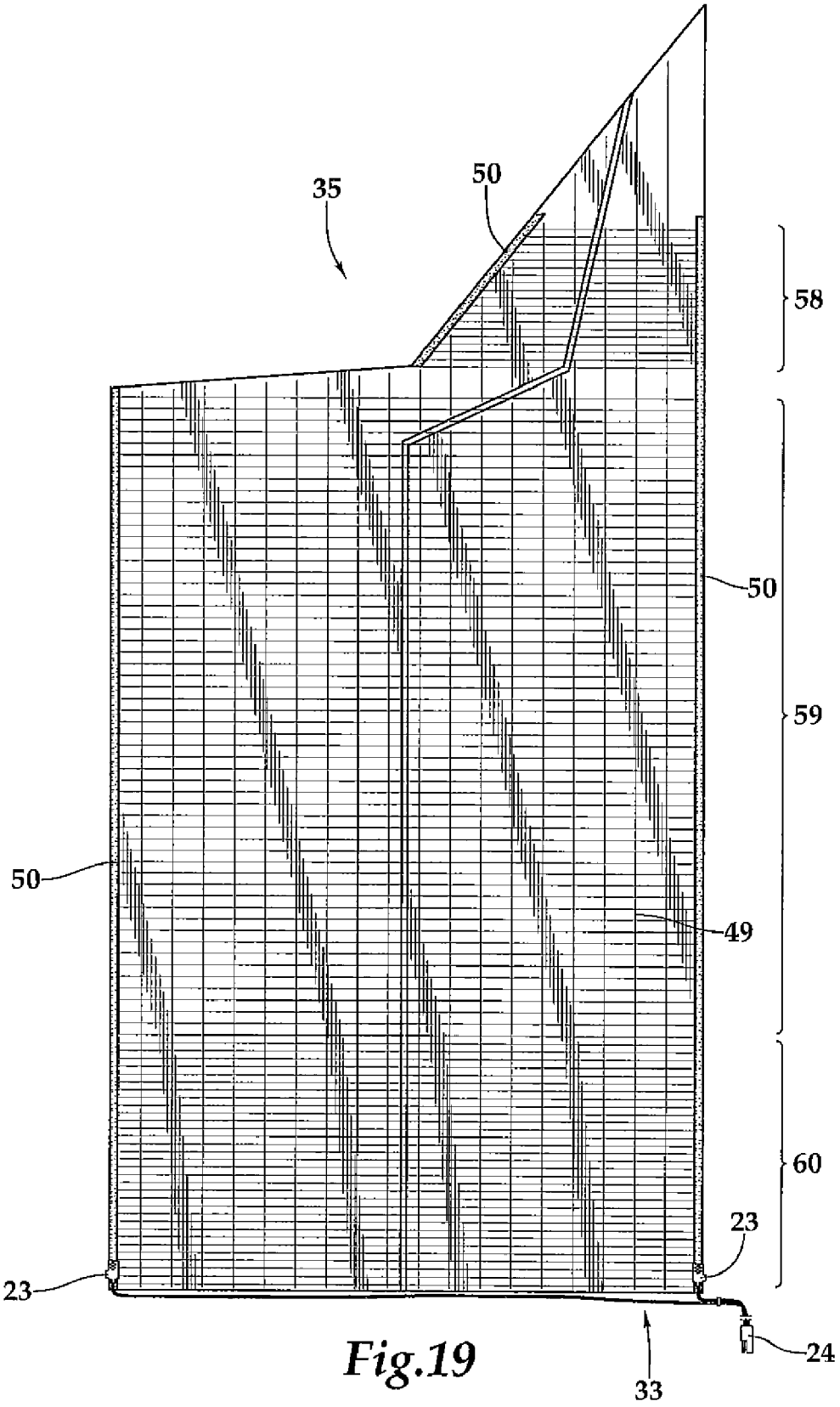
FIG. 19 is a front assembled view of the second part of the vehicle target shown without the front cover sheet.

FIG. 19 is a front assembled view of the second part of the vehicle target shown without the front cover sheet. As shown in this figure, carbon tape 50 is used on either end of the horizontal wires, and as with the human target heaters, each vehicle target heater may have more than one heating zone, a "heating zone" being defined as a portion of a heater that generates a particular wattage. In this example, this particular heater has three heating zones 58, 59 and 60. As explained above in connection with the human targets, the wattage of each heating zone is determined by the diameter, length and alloy of the horizontal wires used. Each heating zone of each vehicle target heater corresponds to a particular portion of a vehicle, and the wattage of each heating zone is preferably specifically tailored to mimic the wattage generated by that portion of the vehicle to which the heating zone corresponds.

Figure 20:
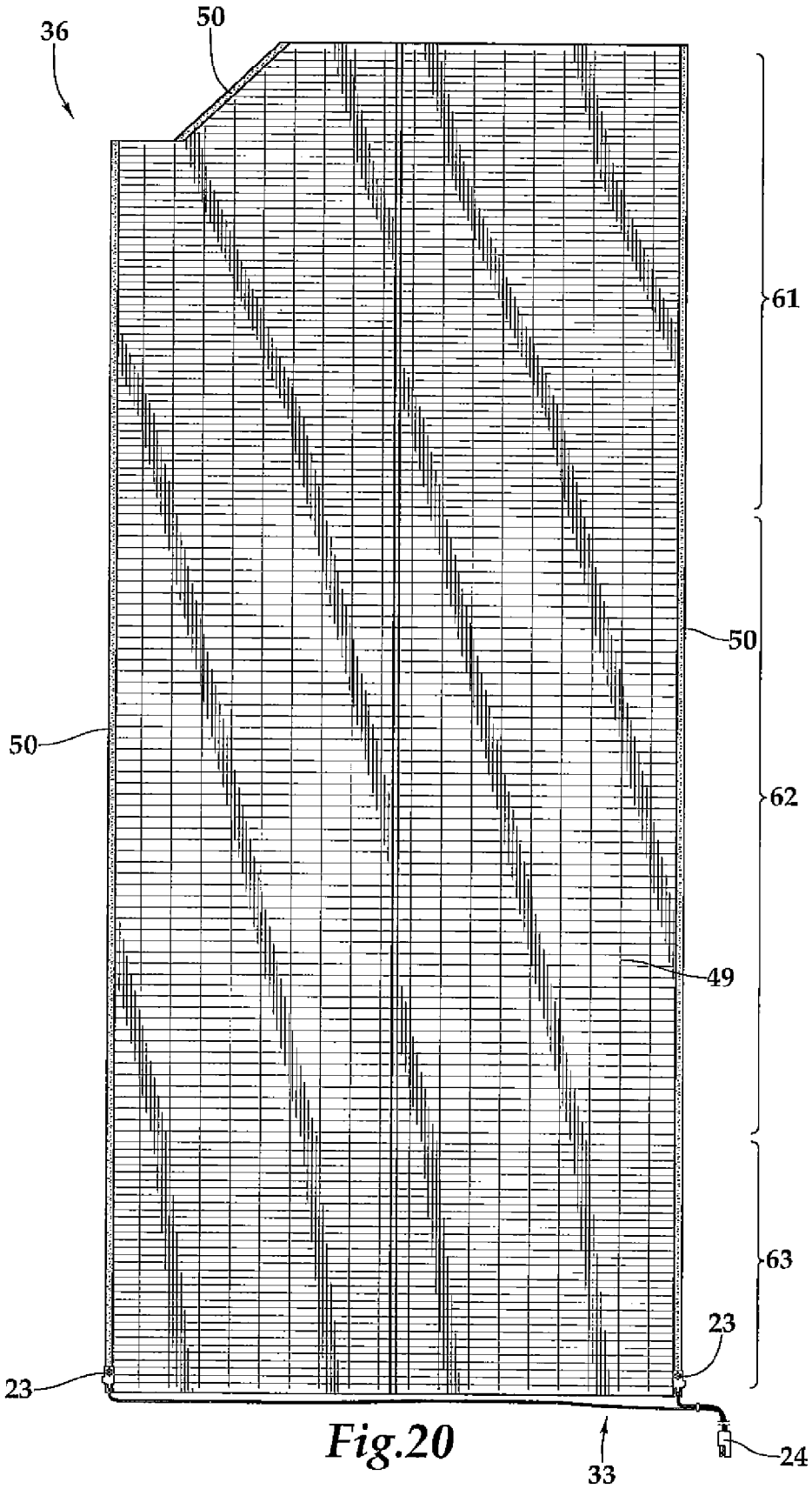
FIG. 20 is a front assembled view of the third part of the vehicle target shown without the front cover sheet.

FIG. 20 is a front assembled view of the third part of the vehicle target shown without the front cover sheet. This heater has three heating zones 61, 62 and 63.

Figure 21:
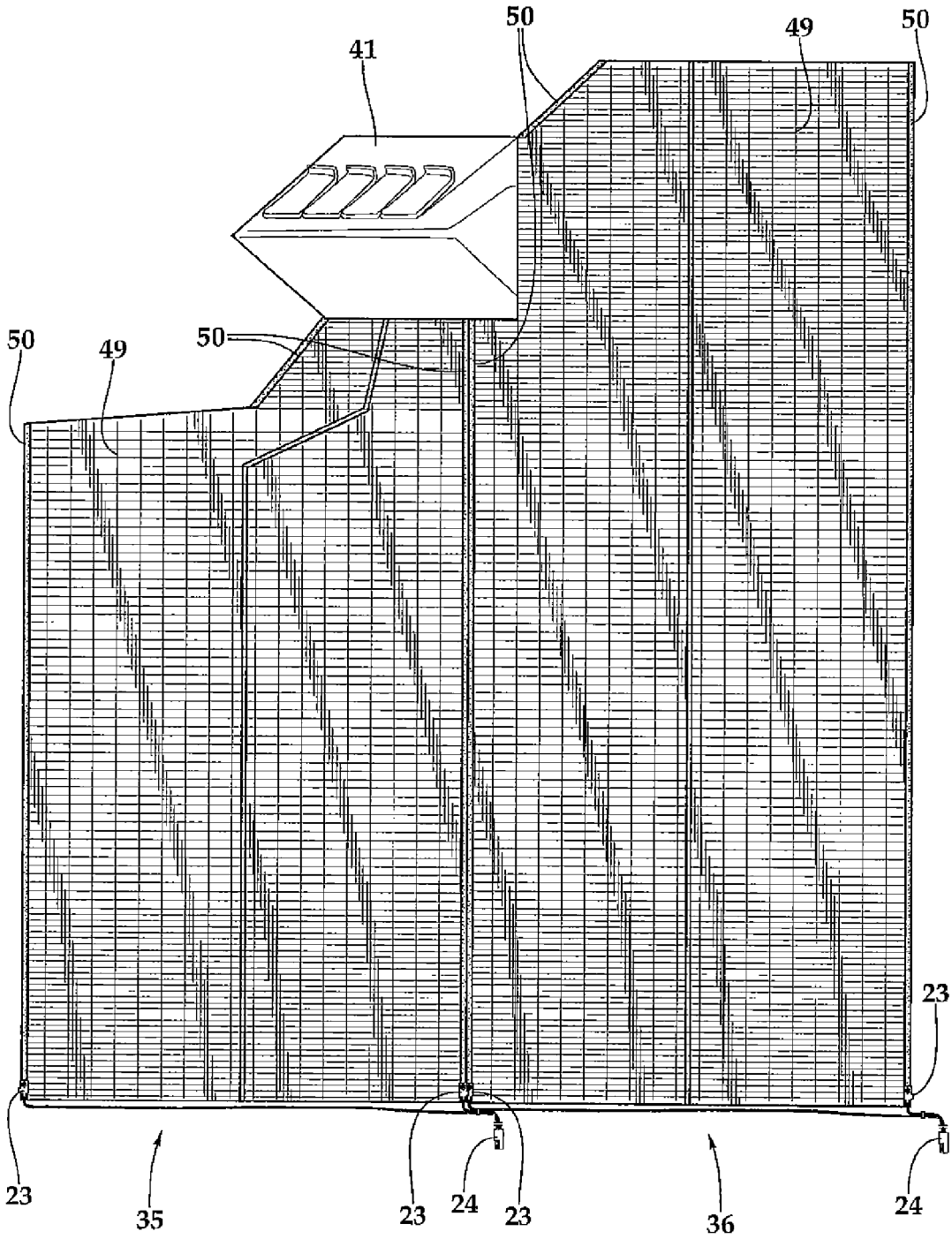
FIG. 21 is a front assembled view of the second and third parts of the vehicle target shown with a first vehicle overlay.

FIG. 21 is a front assembled view of the second and third parts of the vehicle target shown with a first vehicle overlay. An exploded view of the first vehicle overlay 41 is provided in FIG. 28. When the left flank target is fully assembled, the second and third parts 35, 36 of the target are positioned adjacent to one another (see also FIG. 1), and the first vehicle overlay 41 is adhered over the top of both the second and third parts 35, 36, as shown here. The purpose of the vehicle overlays is to provide a "cold spot" in thermal image (as described above in relation to the silhouette accessory 29 of the human targets).

Figure 22:
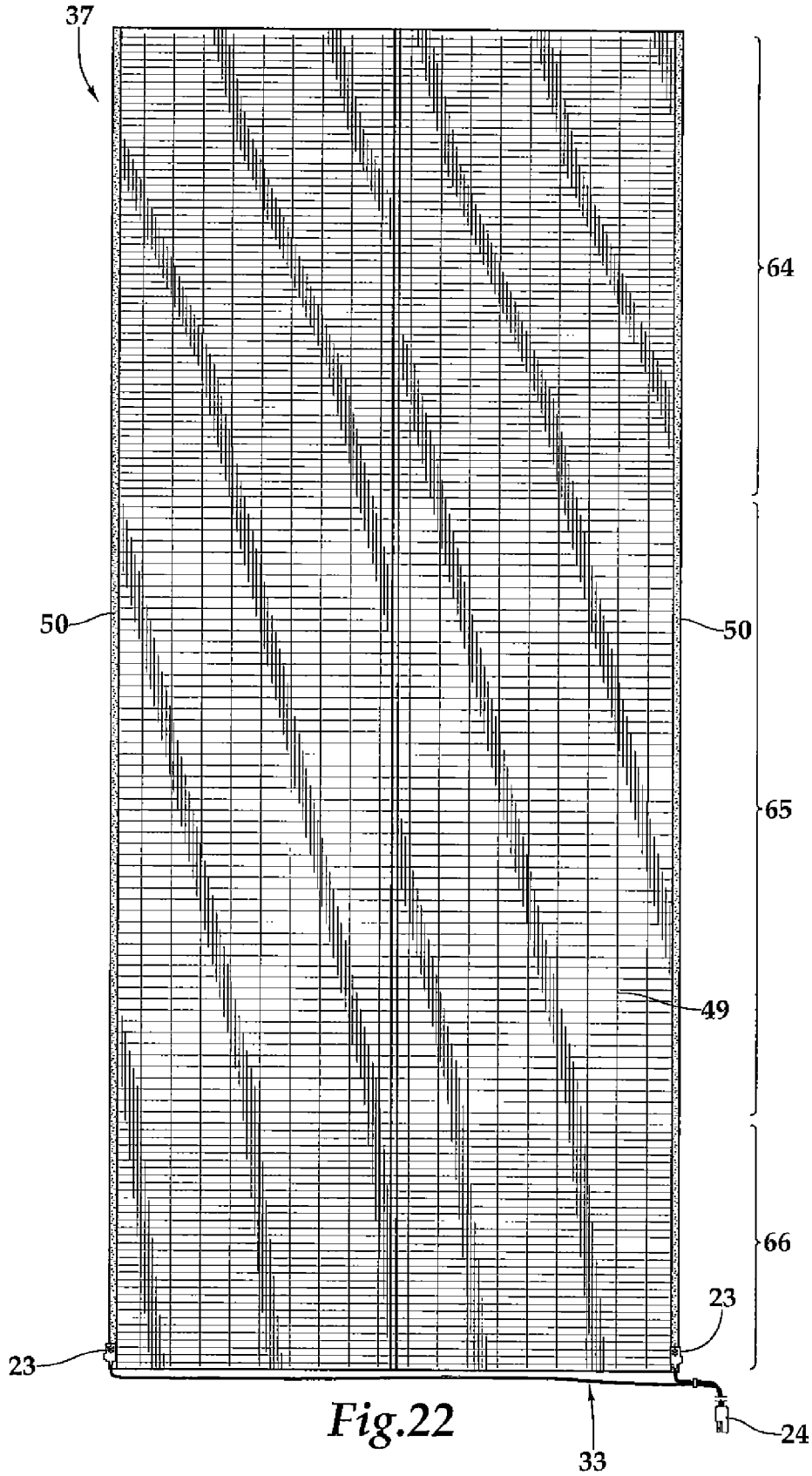
FIG. 22 is a front assembled view of the fourth part of the vehicle target shown without the front cover sheet.

FIG. 22 is a front assembled view of the fourth part of the vehicle target shown without the front cover sheet. This heater has three heating zones 64, 65 and 66.

Figure 23:
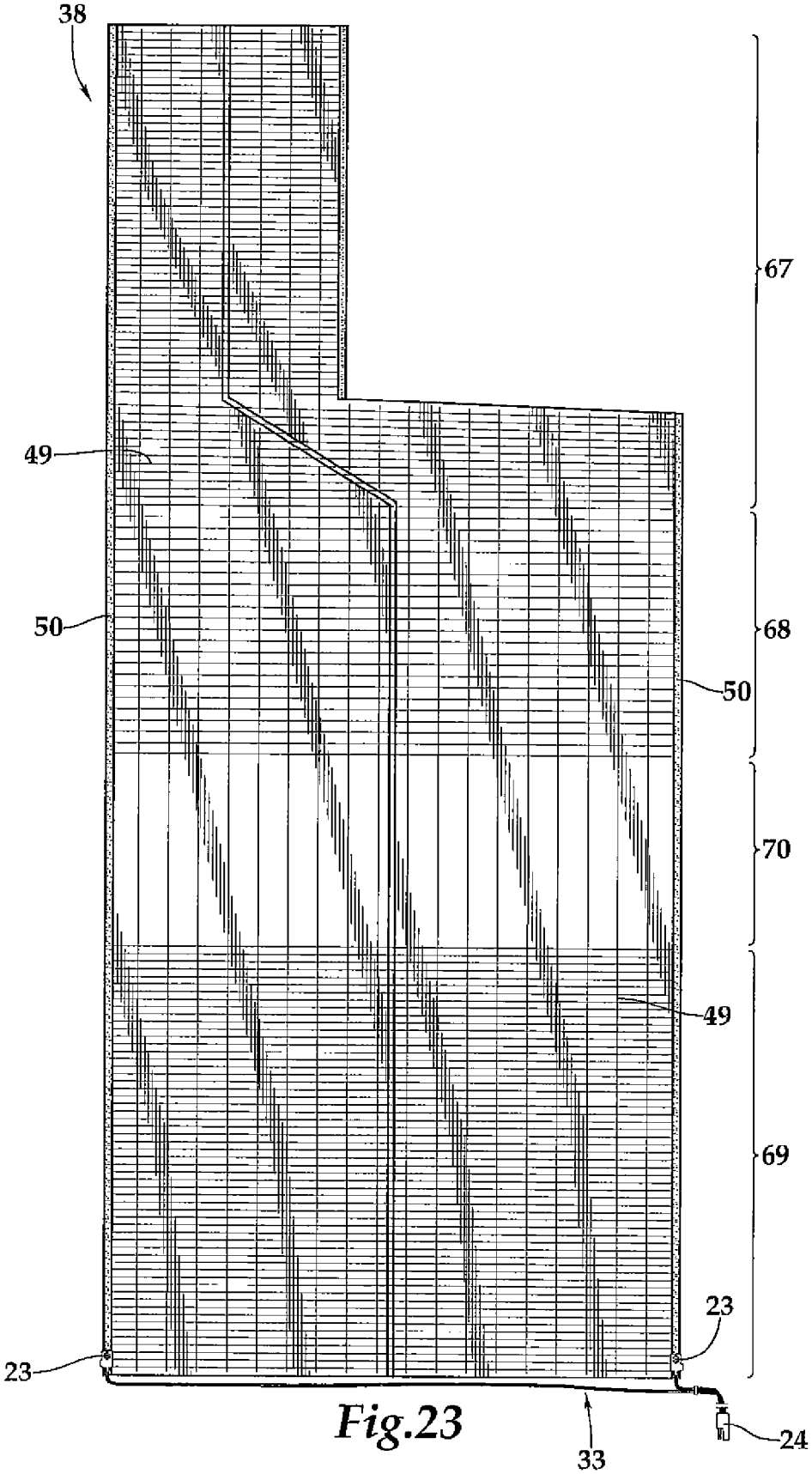
FIG. 23 is a front assembled view of the fifth part of the vehicle target shown without the front cover sheet.

FIG. 23 is a front assembled view of the fifth part of the vehicle target shown without the front cover sheet. This heater has three heating zones 67, 68 and 69. It also has a non-heating zone 70 in which there are no horizontal wires. This non-heating zone 70 corresponds to a door area 71 (see FIG. 12) on the left flank of the T80U Russian tank. Although the door itself is not necessarily visible in FIG. 12 because of the camouflage on the graphic overlay (front cover sheet), it would show up as a cold spot in the thermal image of the tank's left flank.

Figure 24:
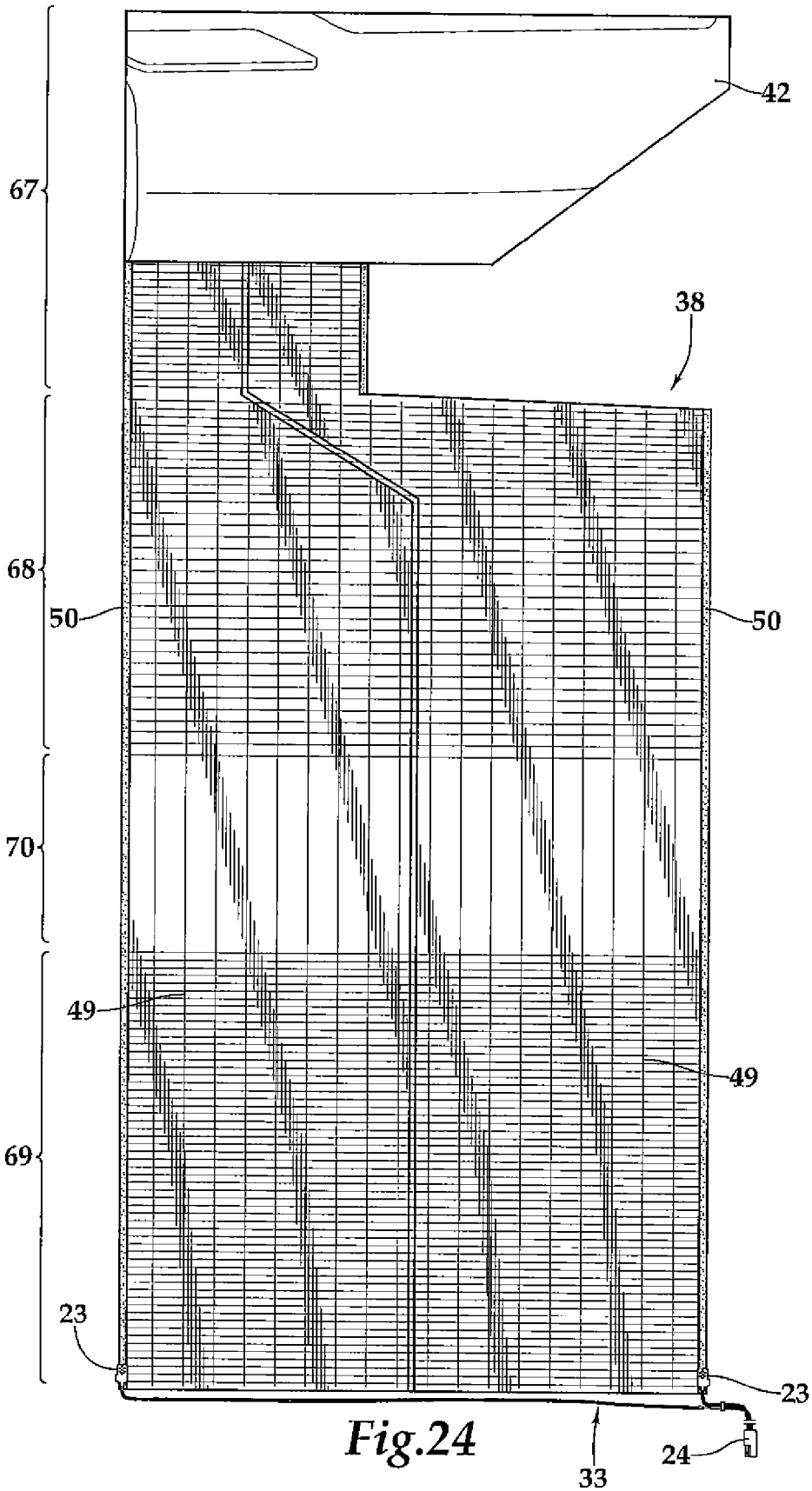
FIG. 24 is a front assembled view of the fifth part of the vehicle target shown with a second vehicle overlay.

FIG. 24 is a front assembled view of the fifth part of the vehicle target shown with a second vehicle overlay. An exploded view of the second vehicle overlay 42 is provided in FIG. 30. When the left flank target is fully assembled, the second vehicle overlay 42 is adhered over the top of the fifth part 38, as shown here. Because this particular overlay hangs out (to the right) of the top of the target, it may also be secured to the fifth part 38 with one or more screws (not shown).

Figure 25:
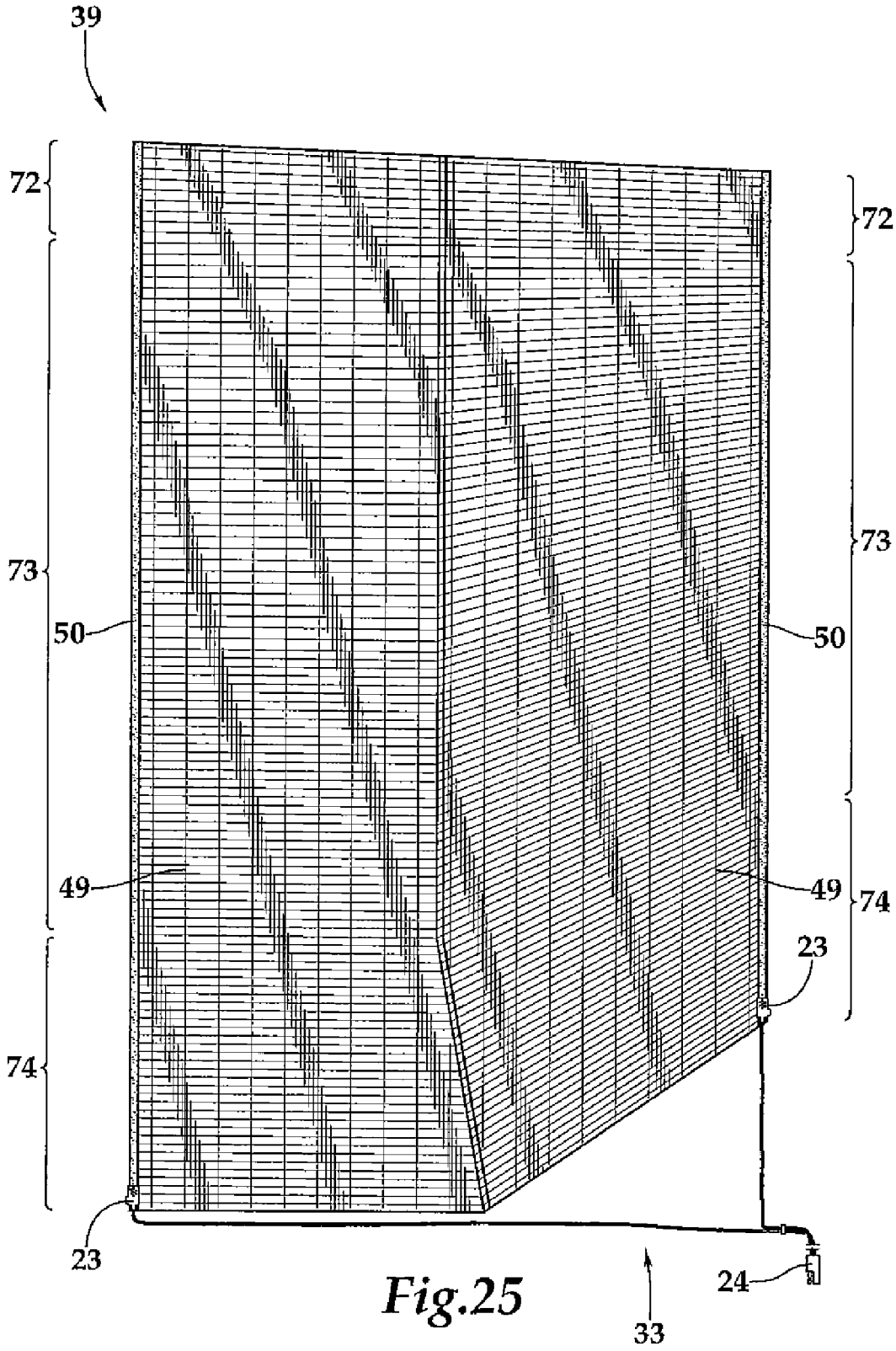
FIG. 25 is a front assembled view of the sixth part of the vehicle target shown without the front cover sheet.

FIG. 25 is a front assembled view of the sixth part of the vehicle target shown without the front cover sheet. This heater has three heating zones 72, 73 and 74. With the exception of the engine zone 72 on the sixth part 39, the track areas (i.e., the bottom-most heating zones in the first, second, third, fourth, fifth, sixth and seventh parts 34, 35, 36, 37, 38, 39 and 40) are the hottest heating zones on the vehicle target parts. The engine zone 72 on the sixth part 39 is also very hot.

Figure 26:
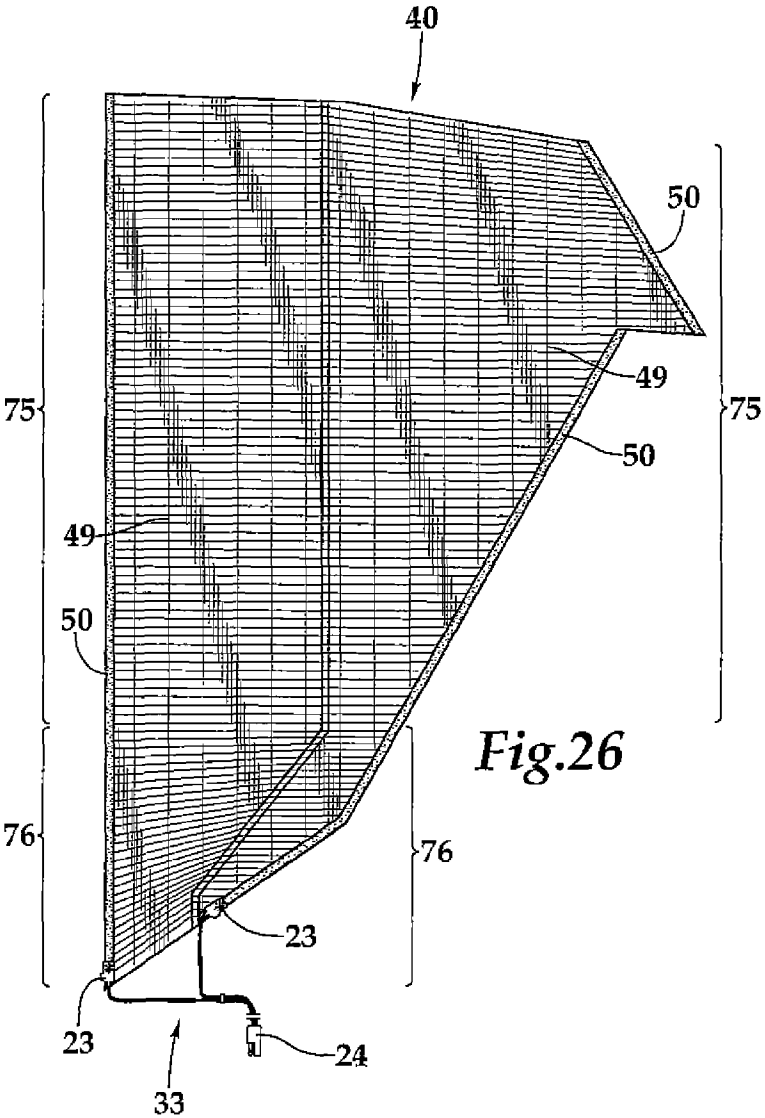
FIG. 26 is a front assembled view of the seventh part of the vehicle target shown without the front cover sheet.

FIG. 26 is a front assembled view of the seventh part of the vehicle target shown without the front cover sheet. This heater has two heating zones 75, 76.

Figure 27:
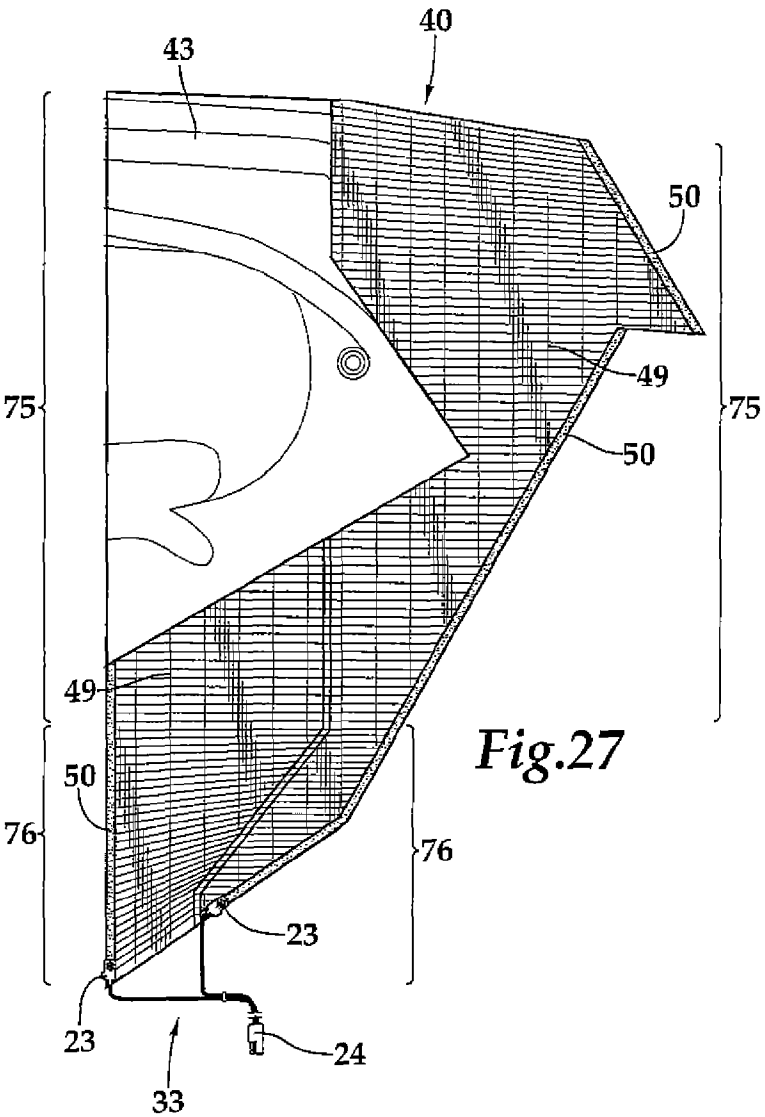
FIG. 27 is a front assembled view of the seventh part of the vehicle target shown with a third vehicle overlay.
Figure 32:
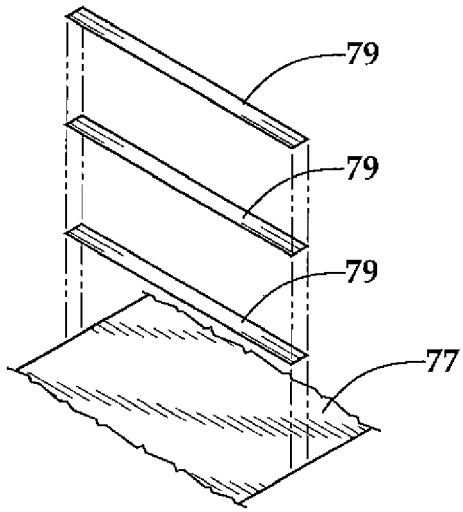
FIG. 32 is an exploded perspective view of the underside of the third vehicle overlay.

FIG. 27 is a front assembled view of the seventh part of the vehicle target shown with a third vehicle overlay. An exploded view of the third vehicle overlay 43 is provided in FIG. 32. This overlay is different in construction than the first and second vehicle overlays 41, 42. The third vehicle overlay 43 is comprised of a single layer of polycarbonate film 77 with a front cover sheet 78. It is adhered to the front surface of the seventh part 40 with polycarbonate film strips 79 (see FIG. 32) that have an adhesive backing. The purpose of the third vehicle overlay 43 is the same as the purpose of the first and second vehicle overlays 41, 42, that is, it provides a "cold spot" (or unheated area) in the thermal image. The vehicle overlays comprised of corrugated plastic (as in vehicle overlays 41 and 42) are preferred when the overlay extends beyond the outline of the vehicle target and needs extra support. The vehicle overlays comprised of polycarbonate film (as in vehicle overlay 43) are preferred when the entire overlay is positioned on top of a heater, and no additional support is required; these overlays are lighter than those made of corrugated plastic.

The present invention is not limited to any particular number, shape, size or configuration or vehicle overlay, and it includes a target with no vehicle overlays at all. The vehicle overlays illustrated in the figures are meant to serve as examples of the types of vehicle overlays that may be used.

Figure 28:
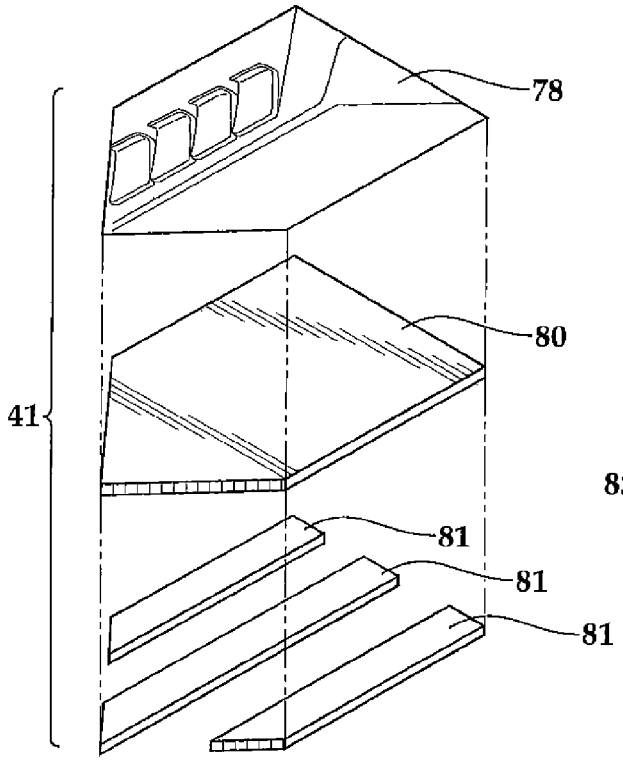
FIG. 28 is an exploded perspective view of the first vehicle overlay.
Figure 29:
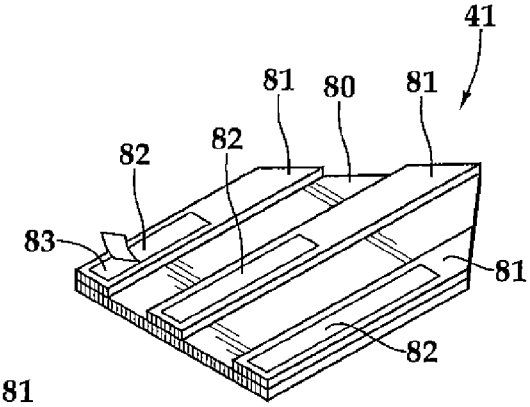
FIG. 29 is a rear assembled view of the first vehicle overlay.
Figure 30:
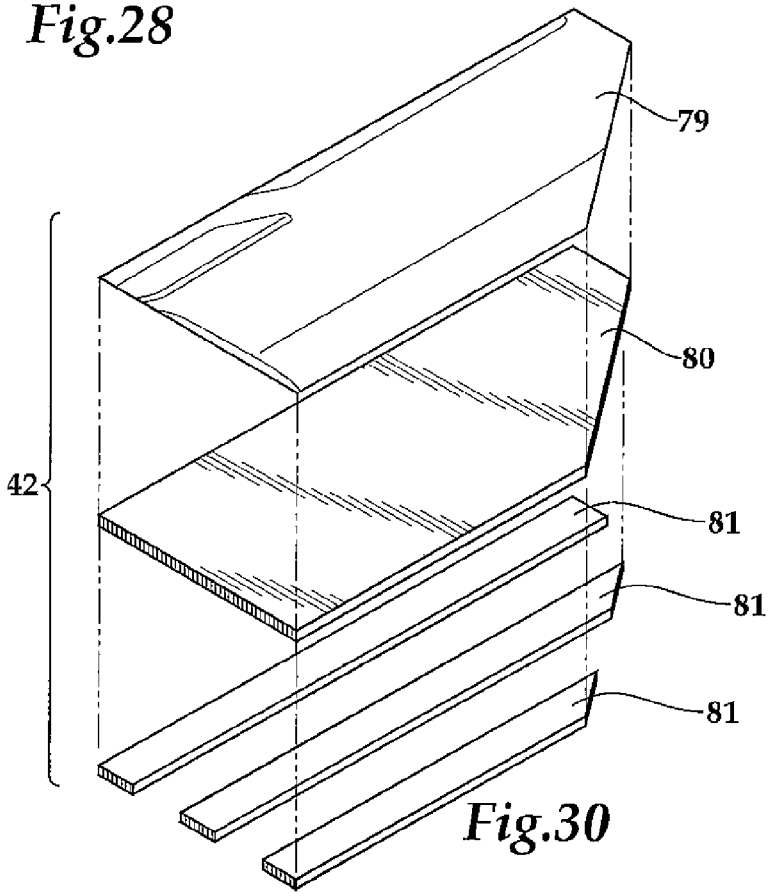
FIG. 30 is an exploded perspective view of the second vehicle overlay.

FIG. 28 is an exploded perspective view of the first vehicle overlay, and FIG. 29 is a rear assembled view of the first vehicle overlay. As shown in these two figures, the first vehicle overlay 41 is comprised of a front cover sheet 79, a layer of corrugated plastic 80, one or more thermal blocks 81, and one or more removable strips 82 on the back side of the thermal blocks 81. The removable strips 82 cover an outer adhesive surface 83 on the thermal blocks 81. FIG. 30 is an exploded perspective view of the second vehicle overlay. It is constructed in the same manner as the first vehicle overlay.

Figure 31:
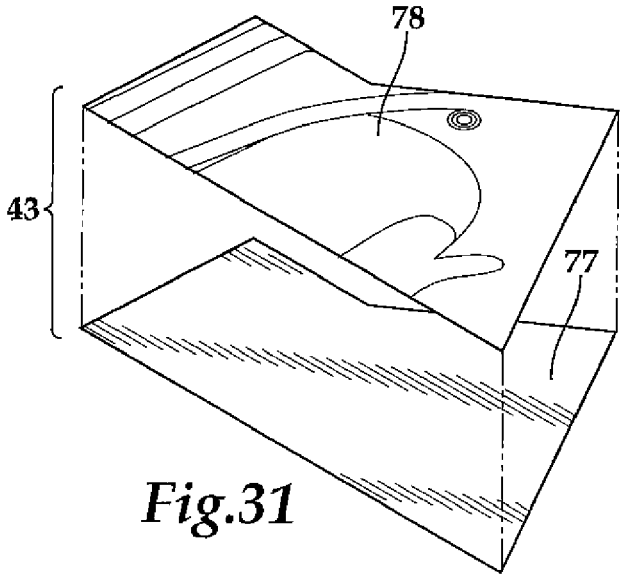
FIG. 31 is an exploded perspective view of the third vehicle overlay.

FIG. 31 is an exploded perspective view of the third vehicle overlay. As noted above, this vehicle overlay is comprised of a layer of polycarbonate film 77 and a front cover sheet 78 and adhered to the front surface of the vehicle target with polycarbonate film strips 79 (see FIG. 32).

Figure 33:
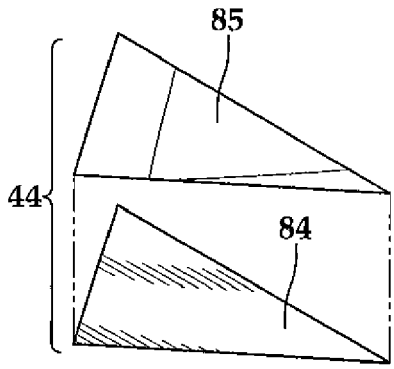
FIG. 33 is an exploded perspective view of the vehicle nose piece.

FIG. 33 is an exploded perspective view of the vehicle nose piece. The vehicle nose piece 44 is constructed in the same manner as the third vehicle overlay 43, that is, with a single layer of polycarbonate film 84 and a front cover sheet 85. The nose piece does not lie on top of a heater and, therefore, may be adhered directly to the rigid backing 45 (if the polycarbonate film layer 84 has an adhesive backing). The polycarbonate film strips 79 of the third vehicle overlay 43 act as a stand-off between the polycarbonate film layer 77 and the heater to which the overlay is adhered, much in the same way that the thermal blocks 81 (preferably comprised of corrugated plastic) of the first and second overlays 41, 42 act as stand-offs. The purpose of the stand-offs is to provide an air gap between the overlay and the heater so that the overlay is not heated by the heater underneath it.

Figure 35:
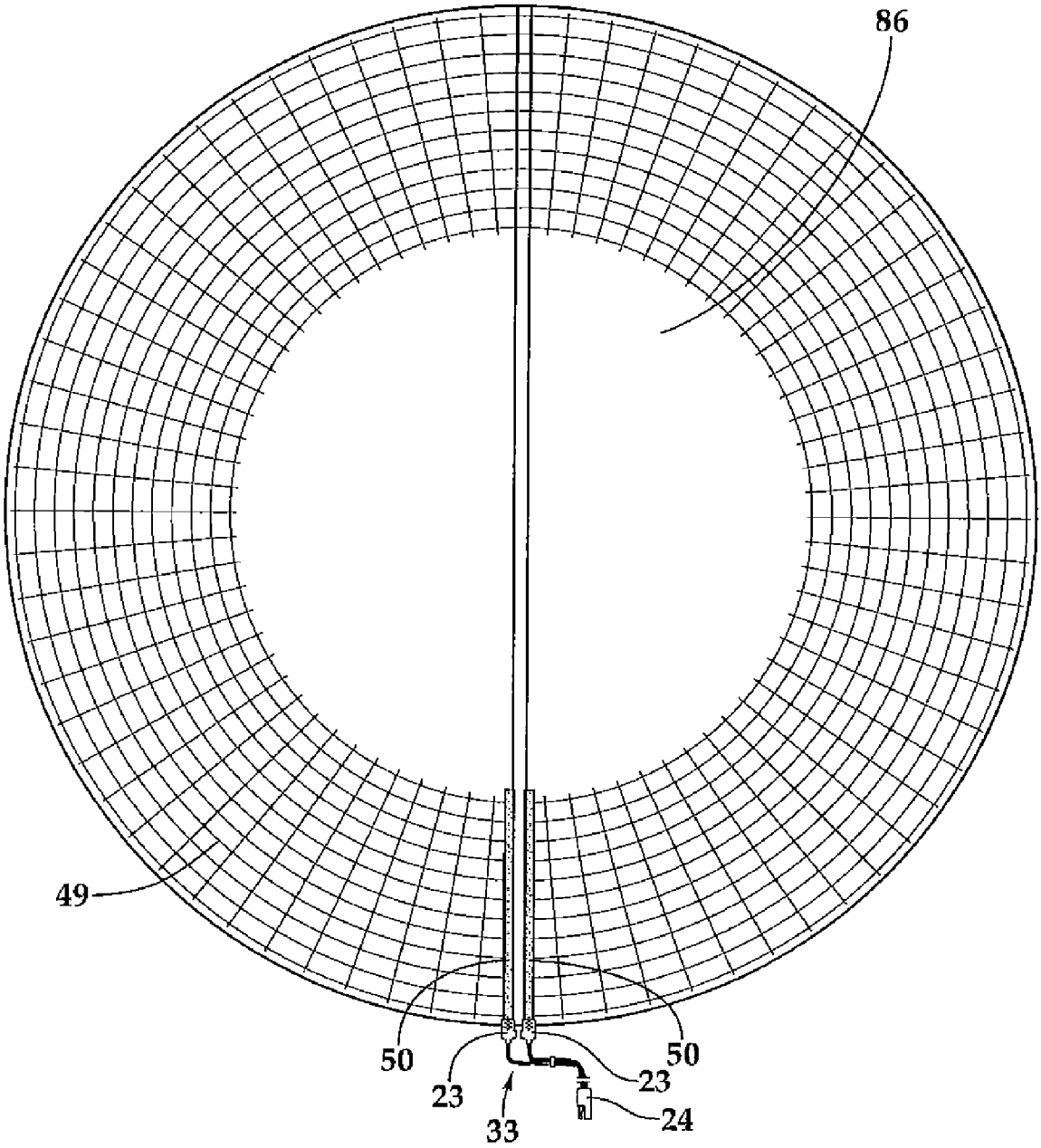
FIG. 35 is a rear assembled view of a wheel embodiment of the present invention.

FIG. 35 is an illustration of an alternate embodiment of the vehicle target described above in which the vehicle at issues comprises a wheel. The wheel shown in FIG. 35 is not part of the Russian tank illustrated in the previous figures but would be part of a different vehicle target. The principles of the present invention, however, apply equally here. The wheel heater shown in FIG. 35 is comprised of two layers of polycarbonate film 86, a bifurcated foil layer (not shown), a plastic layer (not shown), a wire grid 49, carbon tape 50, and a front cover sheet (not shown). A power lead 33 is connected to the two strips of carbon tape 50.

In this embodiment, the two layers of polycarbonate film are situated side-by-side, and they are the same size as the bifurcated foil layer (in other words, one layer of polycarbonate film corresponds to each side of the bifurcated foil layer), except that each half of the bifurcated foil layer comprises a flap (not shown) that folds around the polycarbonate layer 86 and lies underneath the carbon tape 50. The ends of the horizontal wires of the wire grid 49 wrap around the plastic layer, the bifurcated foil layer, and the layer of polycarbonate film so that they lie directly underneath the carbon tape 50 and on top of the foil flaps.

This configuration enables an electrical connection to be made between the carbon tape, the ends of the horizontal wires, and the foil. With the exception of the ends of the horizontal wires (not shown) that lie underneath the carbon tape, the wire grid 49 shown in FIG. 35 actually lies underneath the polycarbonate layer 86, the bifurcated foil layer and the plastic layer (it would be directly underneath the front cover sheet) but is shown here for illustrative purposes. Except for the placement of the carbon tape, the order of the layers is the same as shown in FIG. 13; FIG. 35 shows the underside, or the polycarbonate layer 86, of the target. The advantage of this design—that is, wrapping the foil and the ends of the horizontal wires around to the back of the target and securing them there with the carbon tape—is that it avoids creation of a hot or cold spot on the front of the target (the hot spot would be where the carbon tape is, and the cold spot would be between the two strips of carbon tape).

A significant advantage of the vehicle target heater described above is the fact that it comprises multiple modular sections or parts, each of which comprises one or two heaters in the example provided. This modular design allows for partial replacement of a part or a heater within a part without the entire vehicle target having to be replaced. Due to the unique heater design, and more specifically, the configuration of the horizontal and vertical wires (or elements), each section or part of the vehicle target can withstand multiple hits by a projectile and continue to provide an accurate heat pattern for the vehicle.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A target with a thermal imaging system comprising:

(a) a layer of corrugated plastic;

(b) a layer of bifurcated metallic foil;

(c) a layer of plastic;

(d) a wire grid;

(e) two strips of carbon tape;

(f) a front cover sheet; and (g) a power lead with two first ends and a second end;

wherein the layer of bifurcated metallic foil is situated on top of the layer of corrugated plastic;

wherein the layer of plastic is situated on top of the layer of bifurcated metallic foil;

wherein the wire grid is situated on top of the layer of plastic and comprises a right side and a left side;

wherein one strip of carbon tape is adhered to the right side of the wire grid, and the other strip of carbon tape is adhered to the left side of the wire grid;

wherein the front cover sheet is adhered to the target so that it covers the wire grid and carbon tape; and wherein the power lead comprises two first ends and a second end, each of the strips of carbon tape comprises a first end, one of the first ends of the power lead is connected to the first end of one of the carbon strips, the other first end of the power lead is connected to the first end of the other carbon strip, and the second end of the power lead is a connector plug.

2. The target of claim 1, wherein the first ends of the power lead are comprised of tin, wherein each first end of the power lead comprises teeth, and wherein the teeth punch through the carbon tape and the layer of metallic foil when the first end of the power lead is connected to the first end of the carbon strip.

3. The target of claim 1, further comprising a hard plastic backing that is fastened to the corrugated plastic layer and that is used to secure the target in a target lift device.

4. The target of claim 3, wherein the hard plastic backing is fastened to the corrugated plastic layer in a manner that allows the target to be bent vertically to fit into a target lift device.

5. The target of claim 1, wherein the layer of corrugated plastic comprises an uppermost edge, and wherein a layer of caulk is applied to the uppermost edge of the layer of corrugated plastic.

6. The target of claim 1, wherein the wire grid comprises a plurality of horizontal wires and a plurality of vertical wires; wherein each horizontal wire comprises a first end and a second end; wherein the first end of each horizontal wire comes into contact with one of the strips of carbon tape, and the second end of each horizontal wire comes into contact with the other strip of carbon tape; and wherein none of the vertical wires comes into contact with either of the strips of carbon tape.

7. The target of claim 6, wherein the vertical wires are positioned on top of the horizontal wires.

8. The target of claim 6, wherein the vertical wires are approximately one-half inch apart, and the vertical wires are approximately one inch apart.

9. The target of claim 1, wherein the wire grid is constructed so as to provide different heating zones within the target.

10. The target of claim 9, wherein the different heating zones comprise a head zone, a shoulder zone, and a body zone, wherein the wire grid comprises a plurality of horizontal wires and a plurality of vertical wires, wherein each horizontal wire has a diameter, and wherein the diameter of the horizontal wires differs among the heating zones.

11. The target of claim 1, wherein the wire grid comprises a plurality of horizontal wires and a plurality of vertical wires, wherein the horizontal wires are comprised of a nickel and chrome alloy, wherein each horizontal wire has a diameter, wherein the diameter of the horizontal wires in the head zone is roughly 0.0014 inches, wherein the diameter of the horizontal wires in the shoulder zone is roughly 0.00175 inches, and wherein the diameter of the horizontal wires in the body zone is roughly 0.002 inches.

12. The target of claim 1, wherein the wire grid comprises a plurality of horizontal wires and a plurality of vertical wires, wherein the vertical wires are comprised of a copper and nickel alloy, wherein each vertical wire has a diameter, and wherein the diameter of each vertical wire is roughly 0.004 inches.

13. The target of claim 1, wherein the wire grid comprises a plurality of horizontal wires and a plurality of vertical wires, and wherein the target further comprises a cap zone containing no horizontal wires and into which none of the vertical wires extends.

14. The target of claim 1, wherein the wire grid comprises a plurality of horizontal wires and a plurality of vertical wires, wherein the target has a front surface, and wherein horizontal and vertical wires together comprise less than two percent of the front surface of the target.

15. The target of claim 1, wherein the bifurcated foil layer comprises two outer edges, wherein the first layer of plastic prevents the vertical wires from coming into contact with the bifurcated foil layer, and wherein the first layer of plastic prevents the horizontal wires from coming into contact with the bifurcated foil layer other than at the outer edges of the bifurcated foil layer.

16. The target of claim 1, further comprising a silhouette accessory, wherein the silhouette accessory comprises at least one thermal block with a removable strip and an outer surface comprising an adhesive layer that allows the thermal block to be adhered to the front cover sheet.

17. A target with a thermal imaging system comprising:

(a) a layer of corrugated plastic;

(b) a layer of bifurcated metallic foil;

(c) a layer of plastic;

(d) a wire grid;

(e) two strips of carbon tape;

(f) a front cover sheet; and (g) a power lead with two first ends and a second end;

wherein the layer of bifurcated metallic foil is situated on top of the layer of corrugated plastic;

wherein the layer of plastic is situated on top of the layer of bifurcated metallic foil;

wherein the wire grid is situated on top of the layer of plastic and comprises a right side and a left side;

wherein one strip of carbon tape is adhered to the right side of the wire grid, and the other strip of carbon tape is adhered to the left side of the wire grid; and wherein the power lead comprises two first ends and a second end, the bifurcated metallic foil layer comprises two halves, one of the first ends of the power lead is connected to one half of the bifurcated metallic foil, the other first end of the power lead is connected to the other half of the bifurcated metallic foil, and the second end of the power lead is a connector plug.

18. A target with a thermal imaging system comprising one or more sections, wherein each section of the target comprises at least one heater, and wherein each heater comprises:

(a) a layer of insulating material;

(b) a layer of bifurcated metallic foil;

(c) a layer of plastic;

(d) a wire grid comprised of a plurality of horizontal elements and a plurality of vertical wires;

(e) at least two strips of carbon tape; and (f) a front cover sheet;

wherein the layer of bifurcated metallic foil is situated on top of the layer of insulating material;

wherein the layer of plastic is situated on top of the layer of bifurcated metallic foil;

wherein the layer of insulating material is at least as large as the layer of bifurcated metallic foil;

wherein the wire grid is situated on top of the layer of plastic and comprises at least two outer edges;

wherein one strip of carbon tape is adhered to one of the outer edges of the wire grid, and the other strip of carbon tape is adhered to another outer edge of the wire grid so that both strips of carbon tape come into contact with the horizontal elements but not with the vertical wires;

wherein the front cover sheet is adhered to the heater so that it covers the wire grid and carbon tape; and wherein the front cover sheet comprises an image of a side view, front view or rear view of a vehicle.

19. The target of claim 18, wherein each section has an outline, and wherein when the target is assembled, the outlines of the sections form a single, combined outline, and wherein the single, combined outline is an outline of a vehicle.

20. The target of claim 18, further comprising a power lead with two first ends;

wherein each first end of the power lead is attached to one of the strips of carbon tape.

21. The target of claim 18, further comprising a power lead with two first ends;

wherein the layer of bifurcated metallic foil comprises two halves, and wherein each first end of the power lead is attached directly to one half of the layer of bifurcated metallic foil.

22. The target of claim 20 or 21, wherein the first ends of the power lead are comprised of tin.

23. The target of claim 18, wherein the sections are affixed to a rigid backing.

24. The target of claim 23, wherein the rigid backing is attached to a target lift device.

25. The target of claim 18, wherein the layer of insulating material is polycarbonate film.

26. The target of claim 18, wherein each horizontal element is comprised of multiple wires spun around a fiberglass strand.

27. The target of claim 18, wherein the vertical wires are positioned on top of the horizontal elements.

28. The target of claim 18, wherein the layer of bifurcated metallic foil is comprised of aluminum.

29. The target of claim 18, wherein the layer of bifurcated metallic foil comprises one or more flaps that fold around behind the layer of insulating material.

30. The target of claim 18, wherein the layer of plastic is transparent.

31. The target of claim 18, wherein the bifurcated foil layer has one or more outer edges, wherein the layer of plastic prevents the vertical wires from coming into contact with the bifurcated foil layer, and wherein the layer of plastic prevents the horizontal elements from coming into contact with the bifurcated foil layer other than at the outer edges of the bifurcated foil layer.

32. The target of claim 18, wherein the front cover sheet is comprised of vinyl with an adhesive backing.

33. The target of claim 18, wherein each heater is comprised of one or more heating zones, and wherein each heating zone generates a particular wattage that is different than the wattage of the other heating zones within the same heater.

34. The target of claim 33, wherein the horizontal elements are located within a heating zone, and wherein the horizontal elements are spaced from one another within the heating zone so as to generated a desired wattage within the heating zone within which the horizontal elements are located.

35. The target of claim 18, wherein the front cover sheet is a single front cover sheet that covers all of the sections of the target.

36. The target of claim 18, further comprising an overlay; wherein each section of the target has a front surface; wherein the overlay is comprised of a layer of corrugated plastic, one or more thermal blocks comprised of corrugated plastic, and a front cover sheet; wherein the front cover sheet is adhered to a front surface of the corrugated plastic layer, and the thermal block(s) is/are adhered to a rear surface of the corrugated plastic layer; and wherein the thermal block(s) is/are adhered to the front surface of one of the sections of the target.

37. The target of claim 18, further comprising an overlay; wherein each section of the target has a front surface; wherein the overlay is comprised of a layer of polycarbonate film, at least one stand-off comprised of at least one strip of polycarbonate film, and a front cover sheet; wherein the front cover sheet is adhered to a front surface of the polycarbonate film layer, and the stand-off(s) is/are adhered to a rear surface of the polycarbonate film layer; and wherein the stand-off(s) is/are are adhered to the front surface of one of the sections of the target.

* * * * *

Disclaimer

7,939,802 B2 — Charlie Grady Guinn, Lewistown, MT (US); Edward Donald Schoppman, Oak Ridge, NC (US). TARGET WITH THERMAL IMAGING SYSTEM. Patent dated May 10, 2011. Disclaimer filed March 9, 2011, by the Inventors.

The term of this patent shall not extend beyond the expiration date of Pat. No. 7,820,969.

(*Official Gazette September 6, 2011*)